US005202132A

United States Patent [19]

Myers et al.

[11] Patent Number: 5,202,132

[45] Date of Patent: Apr. 13, 1993

[54] PRODUCTION LINE EQUIPMENT TO MANUFACTURE LARGE CONCRETE PANELS

[75] Inventors: Douglas W. Myers, Redmond, Wash.; R. Gary Fjelland, Salem, Oreg.

[73] Assignee: Concrete Products Incorporated, Redmond, Wash.

[21] Appl. No.: 770,086

[22] Filed: Sep. 30, 1991

[51] Int. Cl.[5] ..... B28B 1/08; B28B 7/06; B28B 7/36; B28B 7/42

[52] U.S. Cl. ..... 425/62; 249/112; 249/137; 249/155; 249/160; 249/189; 425/63; 425/385; 425/456; 425/458

[58] Field of Search ..... 425/385, 62, 63, 121, 425/122, 126.1, 424, 432, 434, 383, 421, 447, 456, 458, 87; 249/137, 112, 155, 160, 189

[56] References Cited

U.S. PATENT DOCUMENTS.

| | | | |
|---|---|---|---|
| 1,440,618 | 1/1923 | Nelson | 249/112 |
| 2,689,381 | 9/1954 | Terriere | 249/112 |
| 3,201,845 | 8/1965 | Strong | 425/218 |
| 3,255,991 | 6/1966 | Sumner | 425/218 |
| 3,645,490 | 2/1972 | Beasley | 249/160 |
| 3,910,738 | 10/1975 | Chandler | 425/456 |
| 3,969,056 | 7/1976 | Larsen | 425/218 |
| 4,005,971 | 2/1977 | Knudsen | 425/456 |
| 4,030,873 | 6/1977 | Morrison | 425/456 |
| 4,050,868 | 9/1977 | Patamaa | 425/456 |
| 4,261,694 | 4/1981 | Morrison | 425/456 |
| 4,321,024 | 3/1982 | Terraillon | 249/160 |
| 4,340,351 | 7/1962 | Owens | 425/456 |
| 4,375,351 | 3/1981 | Allen | 425/458 |
| 4,379,683 | 4/1983 | Rodgers et al. | 425/456 |
| 4,386,901 | 6/1983 | Morrison | 425/456 |
| 4,519,768 | 5/1985 | Murai et al. | 425/456 |

*Primary Examiner*—Jay H. Woo
*Assistant Examiner*—Khanh P. Nguyen
*Attorney, Agent, or Firm*—Roy E. Mattern, Jr.

[57] ABSTRACT

Overall production line equipment is utilized in producing many large concrete panels, in an initial horizontal position, during each day of many operational days, with these panels preferably being later installed vertically with other like panels to form a sound barrier alongside a vehicle way. Each concrete panel has its own integral pilasters at respective edges, in turn having respective tongue and groove edges; respective patterns and color accents on each side, with the pattern on the then top side being formed by using a rockable stamp subassembly, mounted on a cart; reinforcing throughout the panels, inclusive of the integral pilasters; lifting subassemblies; and anchoring subassemblies, adapted to be later mated with a receiving subassembly anchored in a concrete footing, located where the panel with other panels forms a sound barrier alongside vehicle ways. This, production line equipment is extended longitudinally, utilizing tracks to support several electrically powered vehicles, respectively referred to as tarp roller cart, back rail cart, mesh cart, rebar cart, screed cart, color spreader cart, and stamp cart.

54 Claims, 17 Drawing Sheets

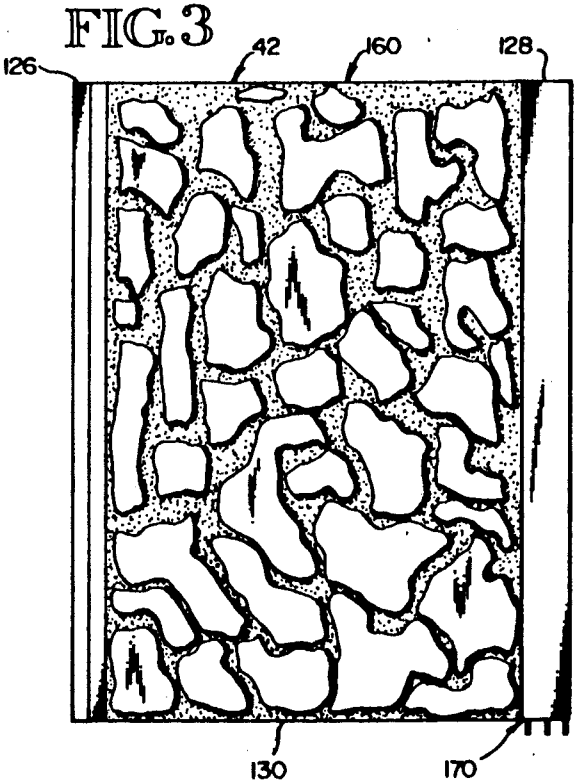
FIG. 3
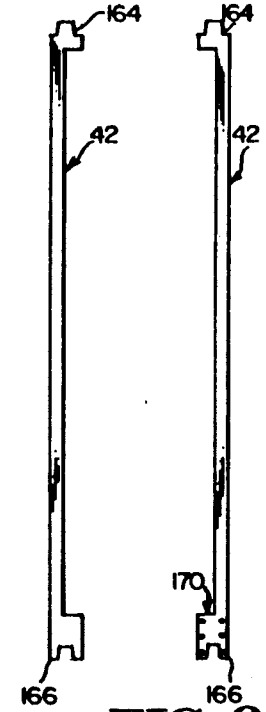
FIG. 5
FIG. 6
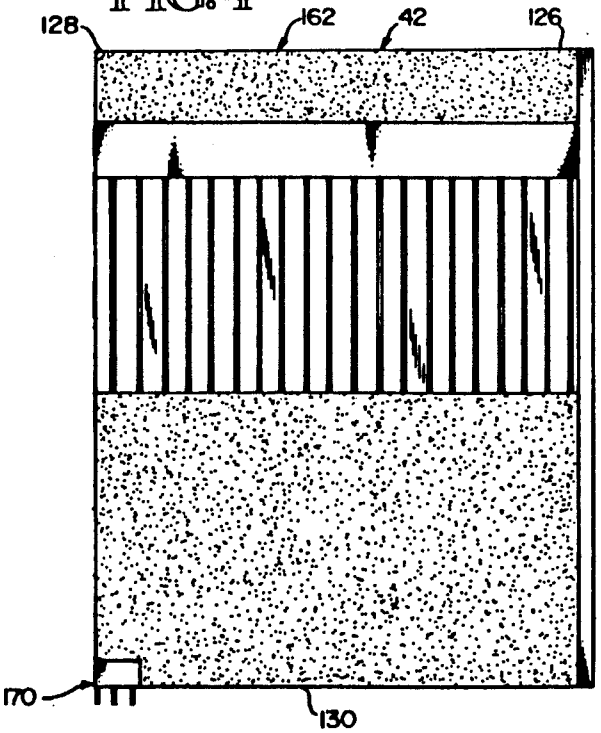
FIG. 4

PRODUCTION LINE EQUIPMENT TO MANUFACTURE LARGE CONCRETE PANELS

BACKGROUND

Concrete structures have been made and used in providing barriers for the noise generated by passing vehicles and for preventing the intrusion of the vehicles themselves. In 1973, William H. Pickett, in his U.S. Pat. No. 3,732,653, illustrated and described his "Barrier Structures and Connectors in Concrete Assemblies". He manufactured precast reinforced concrete members having opposite vertical convex and concave edges, which interfitted with adjacent opposite respective concave and convex edges of the like adjacent precast reinforced concrete members. These adjacent concrete members were arranged in line or at an angle with one another. Additional connectors were utilized.

In 1985, Nicholas W. Melfi in his U.S. Pat. No. 4,558,850 disclosed his "Noise Barrier" formed of precast concrete panels, wherein each pair were made with socket-like joint structures. Then these pairs, with other like pairs, were arranged as a concrete serpentine noise barrier. Additional connectors were utilized.

In 1988, Silvio Diana in his U.S. Pat. No. 4,769,191, illustrated and described his "Monolithic Surface Ornamentation of a Pre-Cast Reinforced Concrete Wall" designed in various embodiments and used as road barriers or barricades. His walls had a monolithic surface ornamentation, inclusive of pigmented cements and designs, to simulate, for example, mortar joints. When necessary each precast wall unit had respective ends formed either as a conical projection or a conical recess, used in coupling adjacent wall units.

In 1990, Donald L. Grieb in his U.S. Pat. No. 4,899,498 disclosed his "Foam Cement Highway Sound Barrier". Cut plastic foam blocks were covered with fiberglass reinforced cement arranged aesthetically. The resulting self supporting foam cement blocks were arranged in alignment or at angles with one another in creating a highway sound barrier.

In respect to making concrete buildings, inventors have manufactured large precast concrete members. In 1939, Ralph C. Yokes, in his U.S. Pat. No. 2,154,590, illustrated and described his "Building Structure". He manufactured precast concrete units with reinforcing elements therein, which could be assembled side by side to form either the floor or the walls of a building. The reinforcing elements, in part, protruded adjacent the edges of these precast concrete units and were later utilized, with other components, during the construction of the building to hold the units together.

In 1971, Delmar L. Thomas, in his U.S. Pat. No. 3,609,935, disclosed his "Permanent Form for Precast Tilt-Up Concrete Modules". He provided a special permanent form used in conjunction with a curing floor, which during the pouring of the concrete formed special edges on the concrete module. These edges later served in making a good connection between these concrete modules and respective later poured pilasters at the erection site.

In 1978, Messrs. Case, Ruppert, and Mánning, in their U.S. Pat. No. 4,123,882 illustrated and disclosed their "Method and Apparatus for Erecting Concrete Wall Panels". When they poured concrete slabs or panels in horizontal positions, they fitted anchor inserts into them, which later received releasable pickup units for the temporary and secure connection of the concrete slab or panel to a hoist.

In 1981, Arthur E. Hilsey in his U.S. Pat. No. 4,290,246, disclosed his "Multiple-Purpose Precast Concrete Panels, and Methods of Constructing Concrete Structures Employing the Same". To eventually complete a larger concrete structure, he prefabricated a plurality of comparatively massive concrete slabs. Each of these slabs had an elongated rectangular opening near the bottom. Later at the erection site a trench was made to receive the bottoms of these slabs. Thereafter, concrete was poured into the trench and passed from one side to the other side of each slab through the elongated rectangular opening, thereby positioning and securing these slabs together. Other securement units were also employed.

In 1986, Melvin M. Zimmerman, in his U.S. Pat. No. 4,605,529, illustrated and described his "Method of Constructing a Prefabricated Concrete Wall Structure". He first manufactured precast concrete studs. Thereafter they were arranged in an assembly jig. Then they were covered by a rigid sheet of insulation, which in turn was covered by a wire mesh. Spacers and fasteners were utilized. Concrete was then poured to completely cover the insulation and the wire mesh, and to surround protruding portions of fasteners, and to fill cavities at the ends of the precast concrete studs. Standard concrete finishing techniques were used to provide different finishes on the concrete. Also other materials, such as brick veneers were laid upon the wet concrete to yield other decorative effects.

In respect to specifically making decorative appearing concrete portions of buildings, Henry C. Barnak in 1957, in his U.S. Pat. No. 2,810,180, disclosed his "Stone Mold", which he used for producing a stone-like finish on a wall surface. After a wall had been completed, a cement stucco or brown coat was applied to the wall, and also another coating was applied. While both of these coatings were setting, a stiff mix of stone-like materials containing a color or colors additive was applied using a hand tool-like mold. This mold had an arcuate base, presenting a convex surface, through which vent holes were formed. Also this arcuate base had both enlarged and recessed portions providing irregular surfaces, which subsequently made the applied stone-like materials appear like natural stone. Sides surrounded the base to form a curved convex volume to receive the colored stiff mix. A longitudinal handle extended across the concave back of the arcuate base. A lubricant was applied to the base before the stiff mix was filled into the curved convex volume. After the stiff mix was distributed evenly in this stone mold, then upon creating a longitudinal rolling motion thereof, this mix was applied to the coated wall. After the setting of all the coatings and this stiff mix, there was a stone-like finish on the wall surface.

Earlier in 1953, Arthur F. Johnson in his U.S. Pat. No. 2,629,135, disclosed his "Method of Concrete Construction". By using molding equipment he created on the flat surfaces of building blocks irregular shapes to resemble stones, which were, however, made of concrete and bonded to the building blocks.

Also earlier in 1931, Richard Carvel in his U.S. Pat. No. 1,809,504, illustrated and described his "Building Construction". In a planar arrangement he formed sections of wall having a stone or brick appearance. After the sections were completed they were hoisted in place to form part of a wall under construction. To create the stone appearance, he arranged a form framework on a level ground area, and then he filled the form with sand to a three or four inch depth. Thereafter he laid pieces of stone fairly close together in the sand. Then he laid reinforcing bars in place. Thereafter concrete was poured into the form covering the reinforcing bars, stones, and sand to create the wall section.

These prior inventors concerned themselves with creating sections of buildings precast horizontally and hoisting them vertically, with creating sections of noise barriers precast horizontally and hoisting them vertically, with creating concrete designs on otherwise planar concrete surfaces to resemble rocks or bricks, with creating colored surfaces on concrete products, with creating designs on concrete blocks, and with creating edges on concrete products for respectively interfitting adjacent concrete panels or slabs together for their in line or angular side by side placement.

SUMMARY

Utilizing the knowledge known in the concrete industry, as exemplified in the patents referred to in the "Background", each of which in turn listed many references to earlier products and methods, and combining this knowledge with information concerning crane equipment, such as powered bridge cranes, other lifting equipment, color pigment distribution equipment, electrical power distribution equipment, hydraulic equipment, vehicle-like equipment, and imprinting equipment, this overall production line equipment and related methods of operations are provided to produce many large concrete sound barrier panels, in an initial horizontal position, during each day, of many operating days.

Each panel has its own integral pilasters at respective edges, in turn having respective tongue and groove edges; respective patterns and color accents on each side, with the pattern on the then top side being formed by using a rockable stamp subassembly mounted on a cart; reinforcing throughout the panels, inclusive of the integral pilasters; lifting subassemblies; and anchoring bolt and plate subassemblies extending from one of the pilasters, to be later mated with a receiving subassembly anchored in a concrete footing located where the panel is to be erected vertically and installed with other like panels. Together these panels create an attractive functional sound barrier alongside vehicle ways, such as freeways, roadways, and streets, thereby making nearby dwelling areas more pleasant to work in and/or to live in.

Although the panels are made specifically to meet detailed specifications, this overall production line equipment and related methods of operations are very easily adjusted to meet other specifications for other types of sound barriers, or for walls of buildings, or for other portions of other structures. Also this overall product line equipment, as illustrated, is readily changed to create panels of different heights, and to present different designs on all the respective sides. These convenient changes as to height and surface designs are prospectively necessary, because of the often varying specifications proposed, or demanded, by different communities, which are thereafter adopted by the designers of these sound barriers.

This overall production line equipment and associated methods of operations are designed to create a high quality concrete product while minimizing the personnel's efforts in handling form assembly parts, and minimizing the need for using independently operating lifting machinery, such as forklifts. To reach these objectives, form assemblies, presently numbering twenty, are arranged in a five hundred and twenty foot long production line having continuous tracks for electrical powered vehicles to run on. These vehicles are referred to as tarp roller cart, back rail cart, mesh cart, rebar cart, screed cart, color spreader cart, and stamp cart. Electrical power is distributed via a two hundred and forty volt continuous uninterrupted electric T-track power supply system. Each cart has power outlets used in powering hand held electrical powered tools, and electrical circuits to operate components which are mounted on some of the respective carts.

Each form assembly, inclusive of the deck, forms, and track sections thereof, and a cured completed concrete panel is tiltable to an inclined position to facilitate the subsequent stripping of the concrete panel from the form assembly. Each form assembly includes a liner subassembly of plywood covered with a rubber or rubber like liner on which a specified design is created. Therefore before stripping, tilt brackets are temporarily installed to receive the weight of the concrete panel, and thereafter during stripping, to rotate the concrete panel about a then removed center of rotation established by the tilt brackets Following this arc of rotation, the tilting concrete panel is kept well spaced and clear of the liner and the design thereon, avoiding any possibility of damaging the liner.

BRIEF DESCRIPTION OF THE DRAWINGS

The overall production line equipment operated to produce many large concrete panels to be used as a sound barrier alongside a vehicle way, is illustrated in the drawings, wherein:

FIG. 3 is a side view of the preferred concrete panel which faces a community;

FIG. 4 is a side view of the preferred concrete panel which faces a vehicle way;

FIG. 5 is a top view of the concrete panel, showing the respective tongue and groove edges;

FIG. 6 is a bottom view of the concrete panel showing an anchoring subassembly adapted to be later mated with a receiving subassembly anchored in a concrete footing;

DETAILED DESCRIPTION OF THE DRAWINGS

Figure 1:
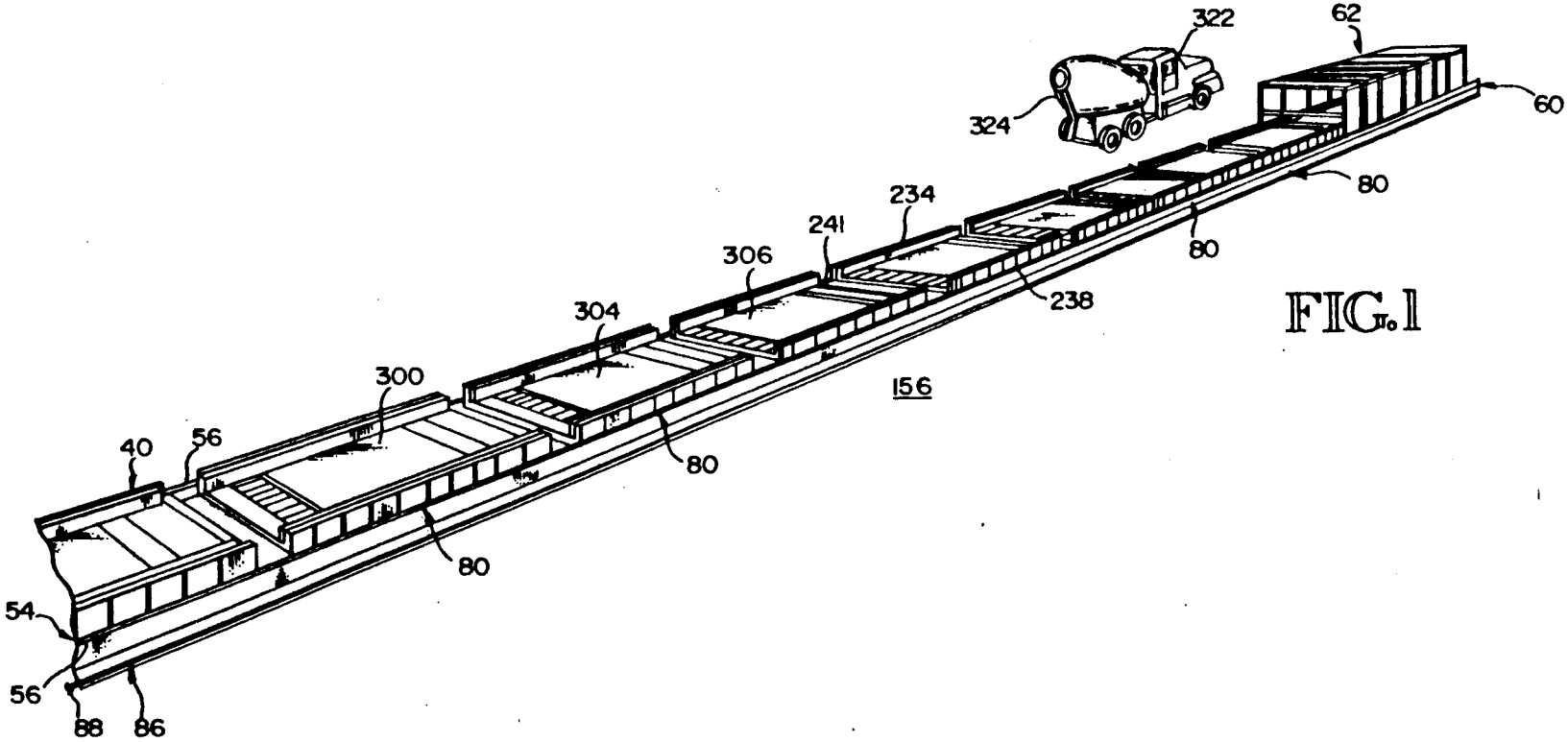
FIG. 1 is a top view of the overall product line equipment, before concrete panels have been poured, of like tiltable assemblies of form components, inclusive of tracks, to guide carts, receiving electrical power, for operating: their motors; associated hand held powered tools; and component lifting and handling equipment; via a continuous electric T-track power supply.
Figure 2:
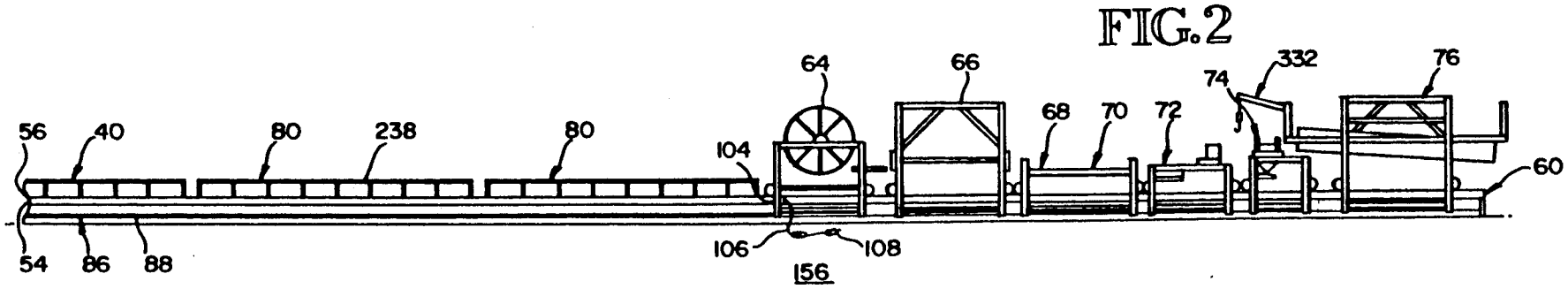
FIG. 2 is a side view of the overall production line equipment shown in FIG. 1.
Figure 7:
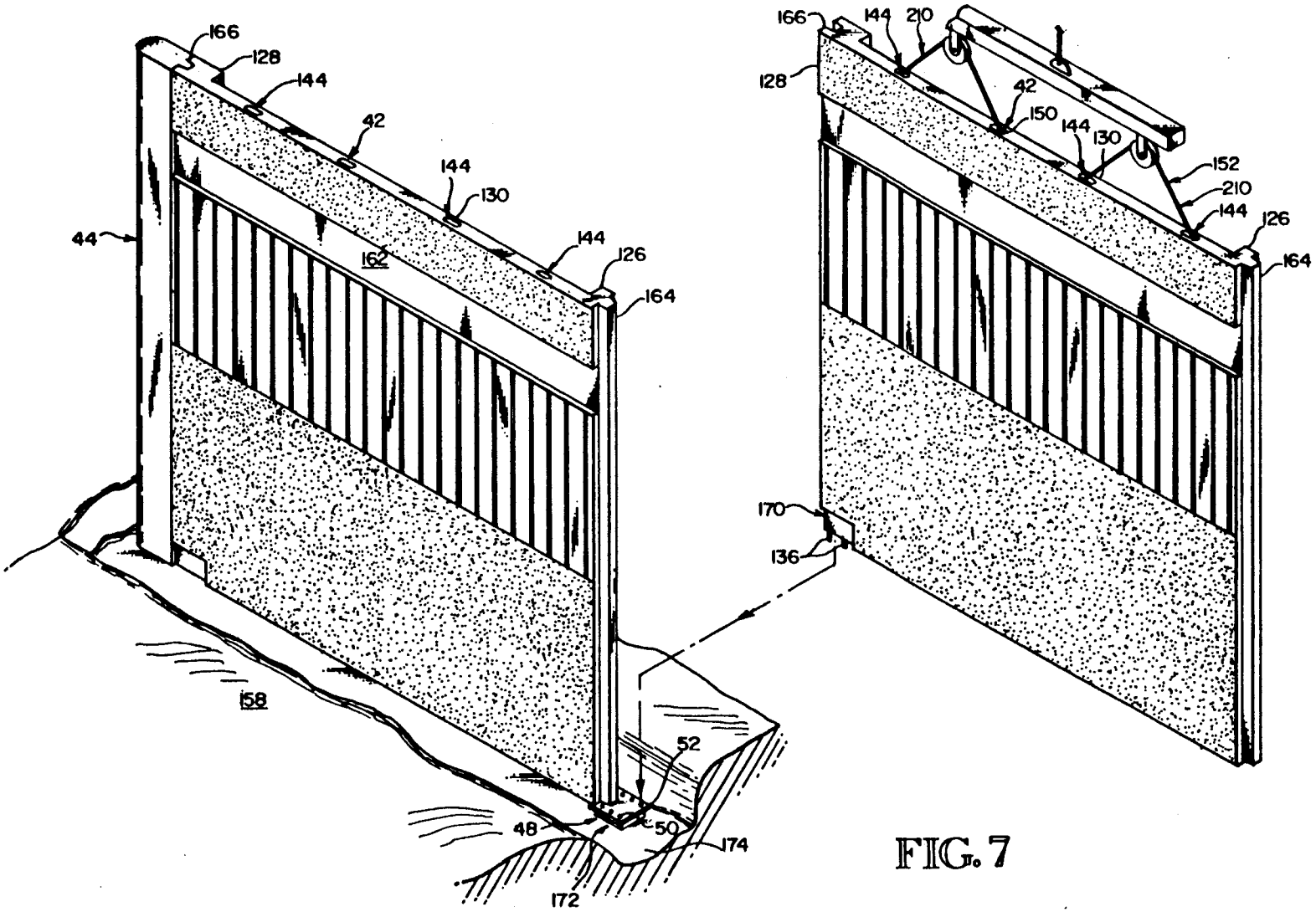
FIG. 7 is a perspective partial view showing the start of the erection of a sound barrier made by using these concrete panels.
Figure 8:
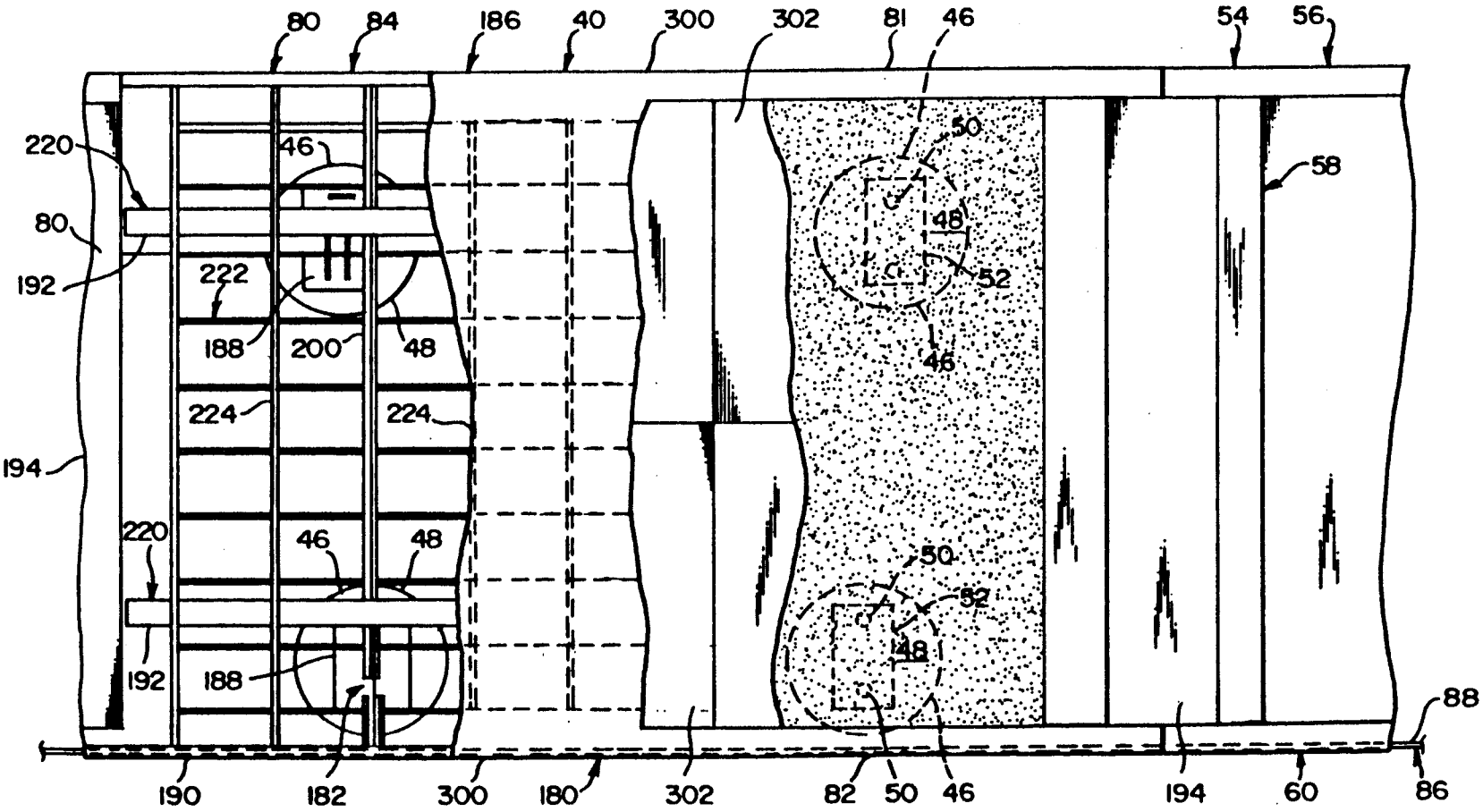
FIG. 8 is a plan view, with some portions removed for illustration purposes, of a portion of the extended tracks, and of the adjacent first one of several like tilt table assemblies.
Figure 9:
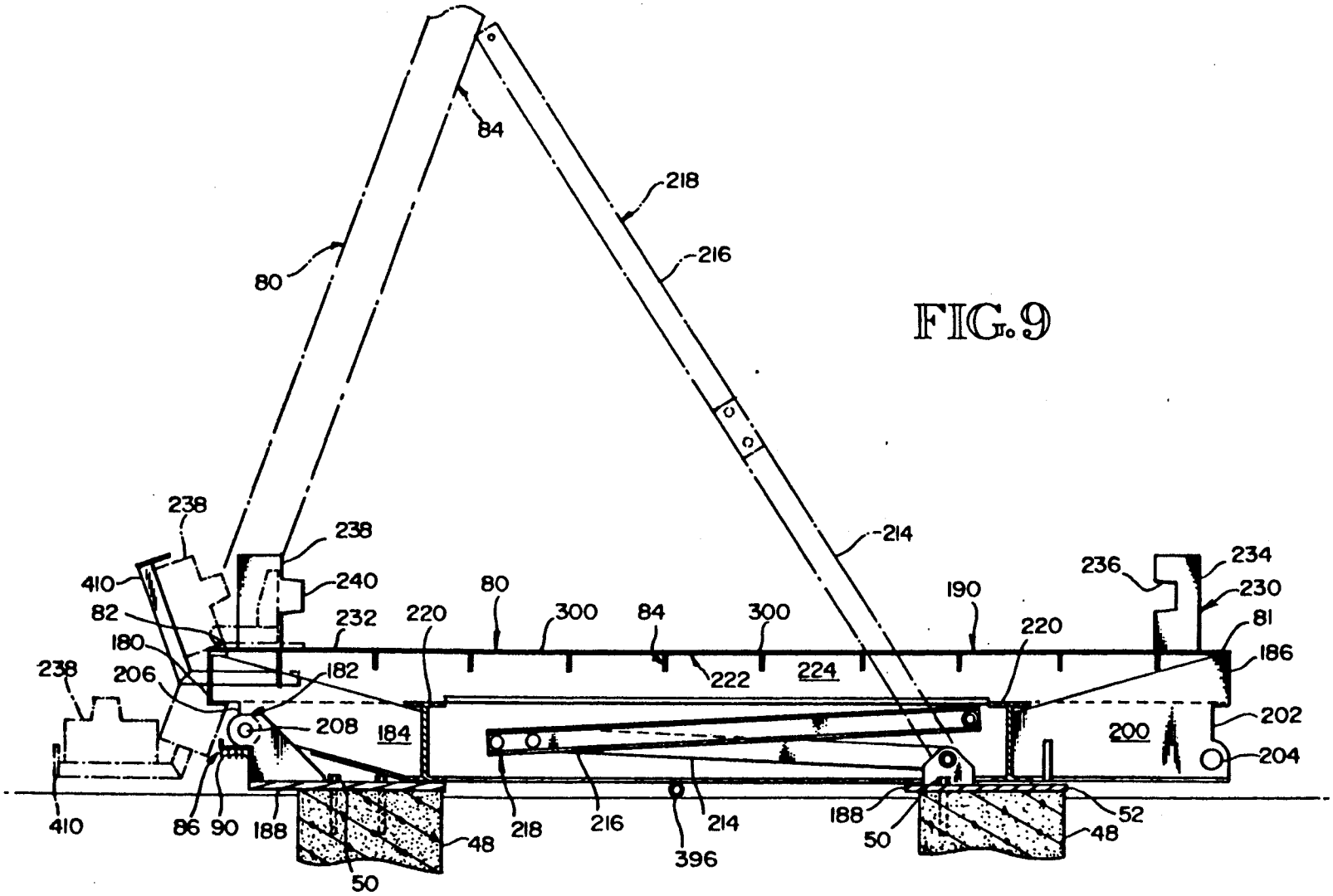
FIG. 9 is an end or transverse elevational view, with some portions removed or shown in section for illustration purposes, of the first one of several like tilt table assemblies.
Figure 10:
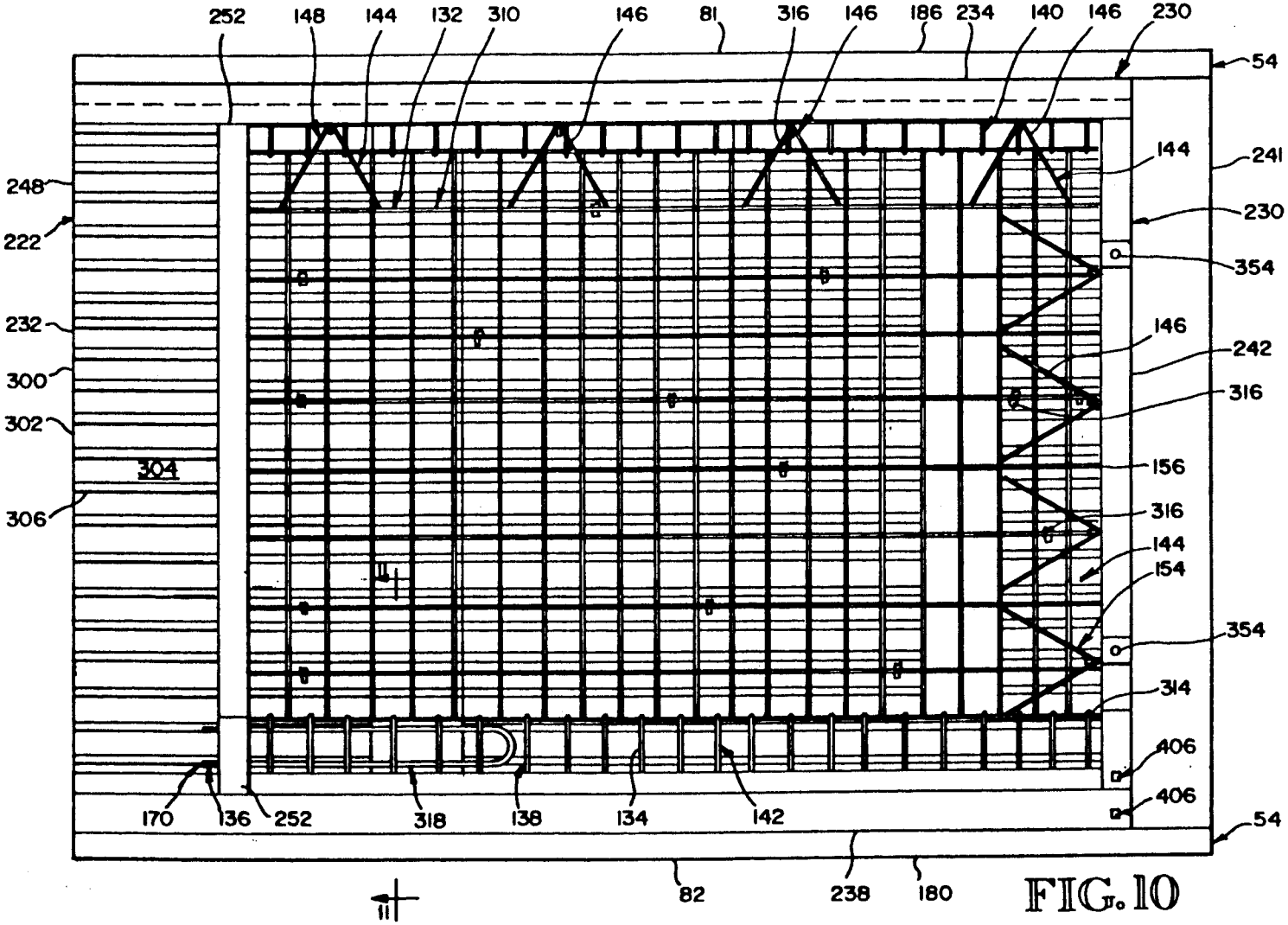
FIG. 10 is a partial plan view of a tilt table assembly showing the arrangement, with portions removed for illustration purposes, of the pre-oiled overall form assembly parts.
Figure 13:
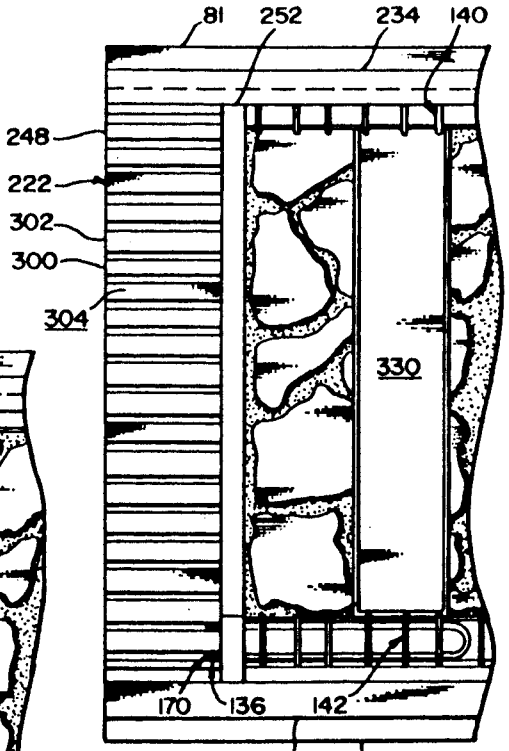
FIG. 13 is a partial plan view, indicating how optionally, a color template is selectably placed over some surface portion of the first pour of concrete.
Figure 12:
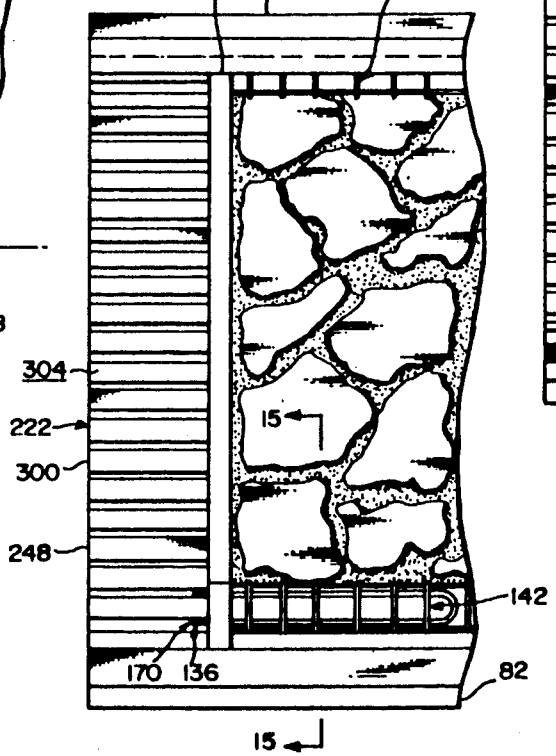
FIG. 12 is a partial plan view of the tilt table assembly, similar to FIG. 10, illustrating, however, how the top surface portions of the first concrete pour appear with a design thereon.
Figure 11:
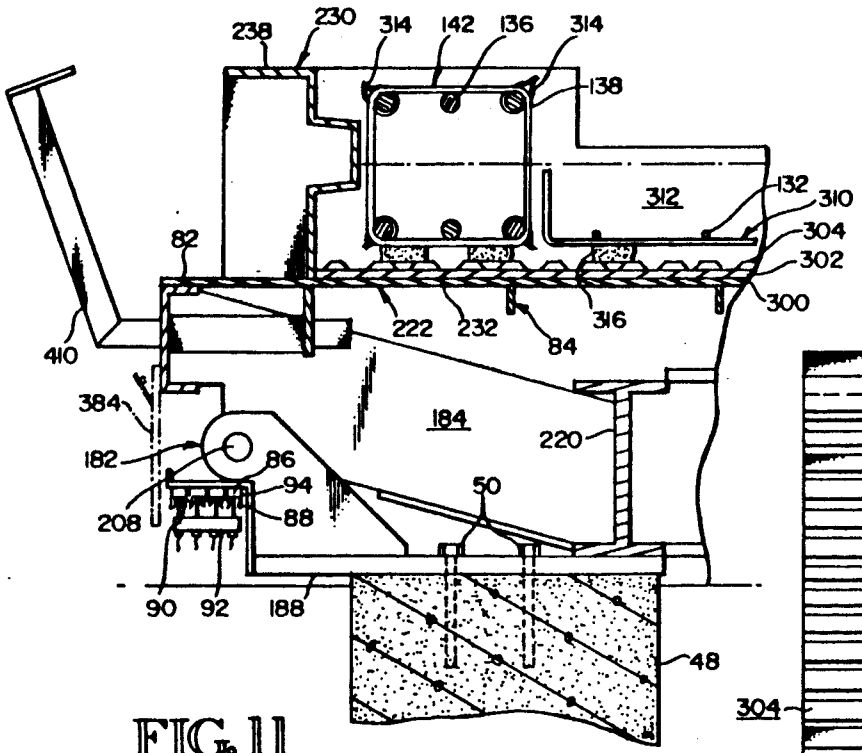
FIG. 11 is a partial sectional view of the tilt table assembly, taken on line 11—11 of FIG. 10, illustrating the arrangement of many of the various components illustrated in FIG. 10, and indicating the level of the first pour of concrete, by using phantom lines.
Figure 14:
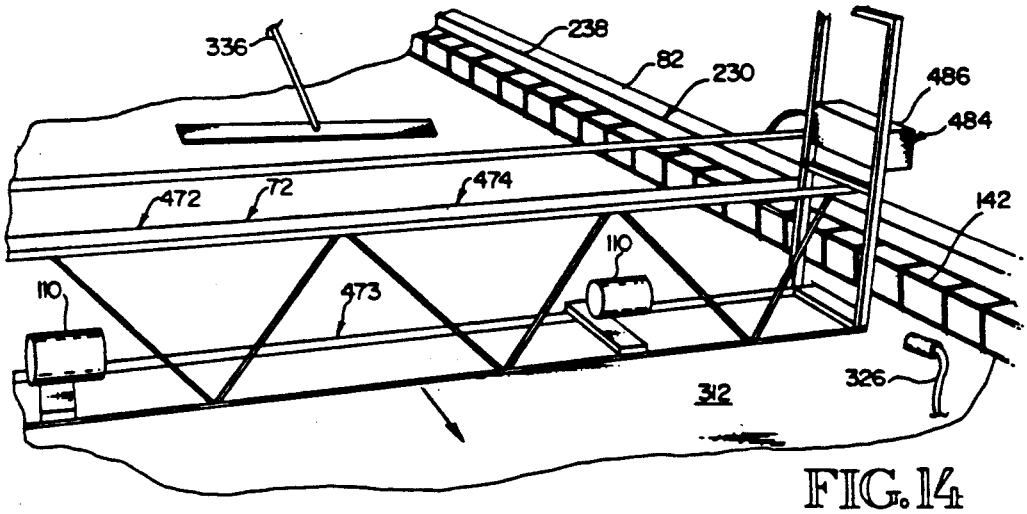
FIG. 14 is a perspective view of portions of the screed assembly showing how a bull float is used to float a base color into the surface portions of a concrete panel, and also showing how a small internal vibrator is used to eliminate rock pockets and voids.
Figure 15:
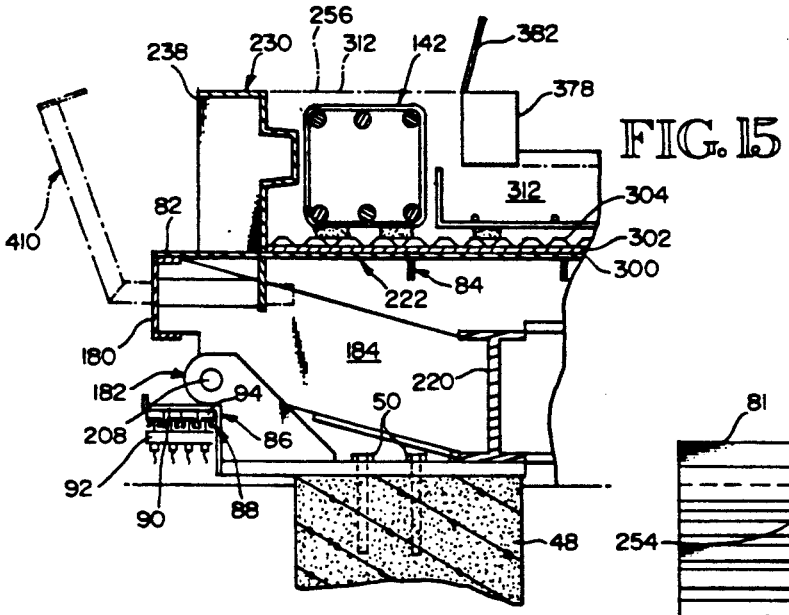
FIG. 15 is a partial sectional view of the tilt table assembly, at the location of line 15—15 of FIG. 12, showing the additional placement of one of the respective inside back rails of the form assembly, and indicating the level of the combined first and second pours of concrete in the pilasters, by using phantom lines.
Figure 16:
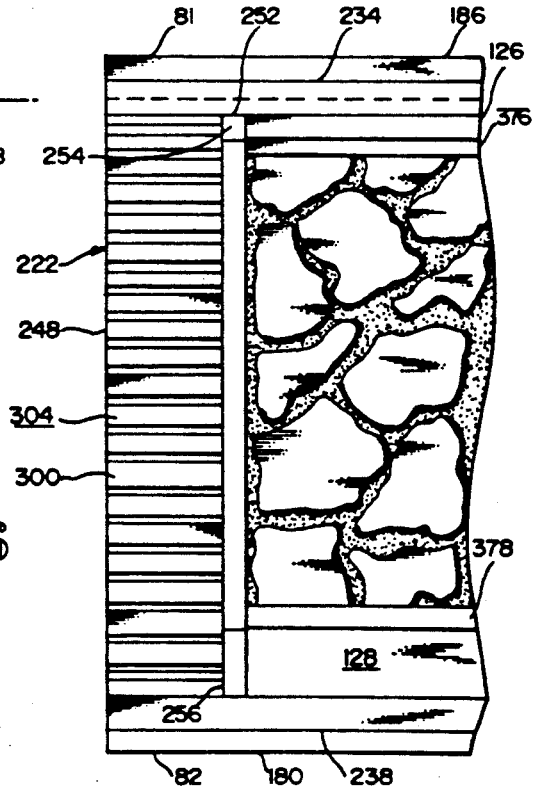
FIG. 16 is a partial plan view of a tilt table assembly, and the form assembly, after the second pour of concrete has been undertaken, and the form assembly is still in place, showing the smooth surface portions of the pilasters, and indicating the design configurations on the community side of the concrete panel.
Figure 17:
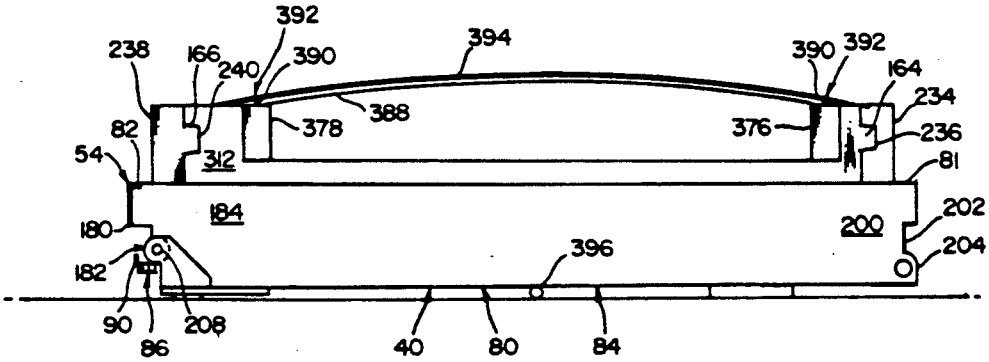
FIG. 17 is a partial end view of a tilt table assembly and the form assembly, showing a cross section of a tarp, used to confine steam, entering from a manifold, heating the concrete to cure it faster.
Figure 18:
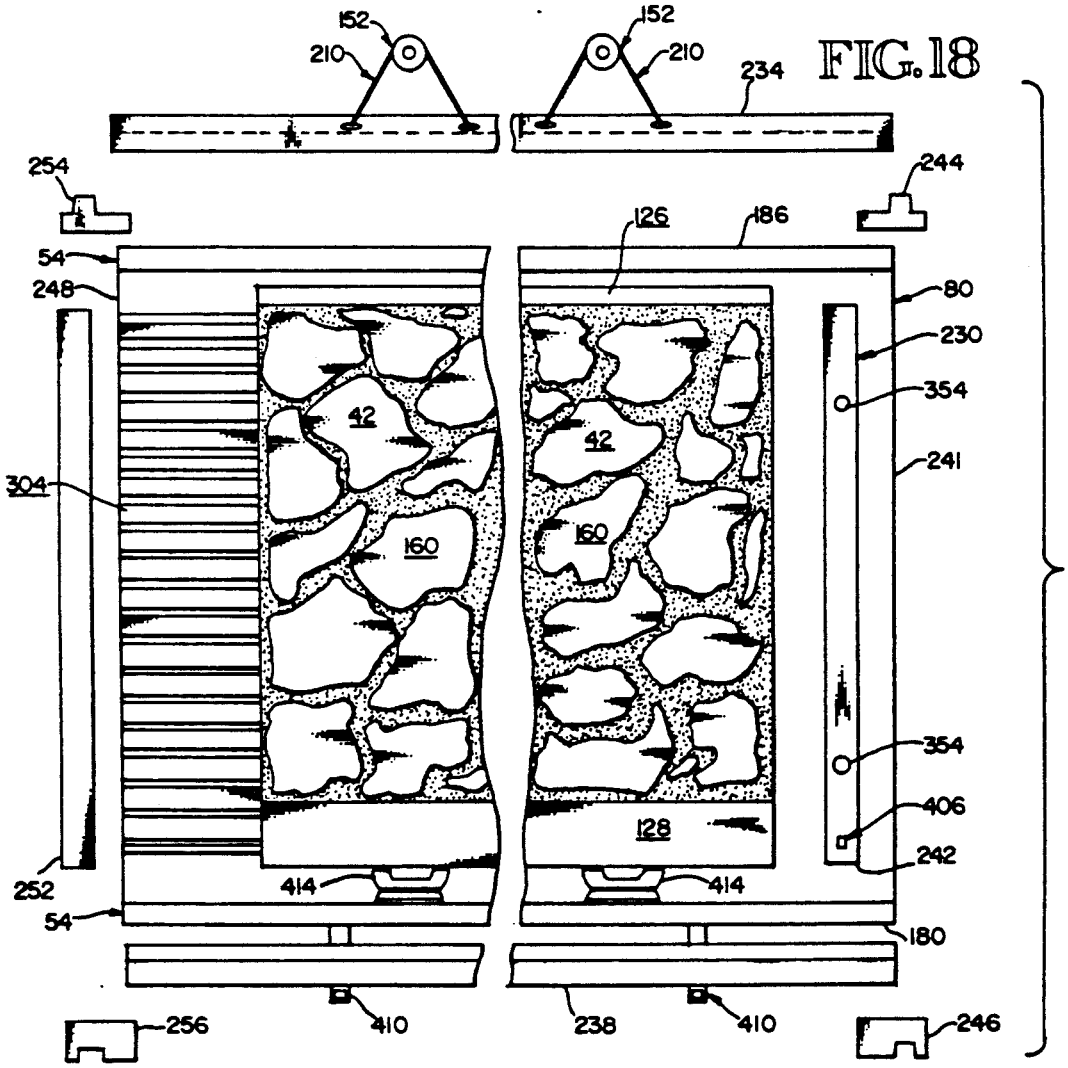
FIG. 18 is a partial plan view of a tilt table assembly and the form assembly, after the second pour of concrete, and portions thereof have ben removed clear of the concrete panel, in preparation for the tilting of the tile table.
Figure 19:
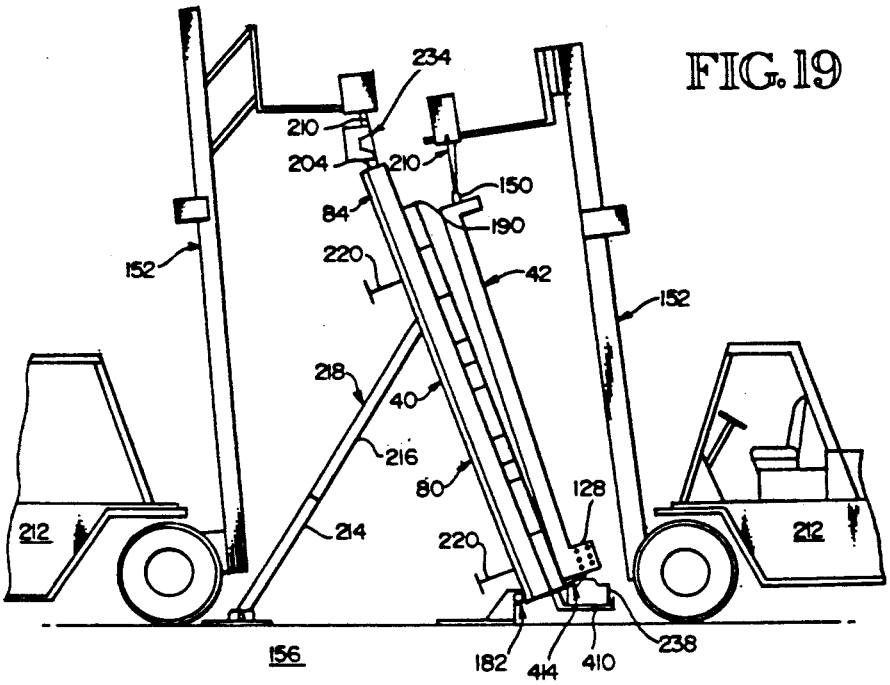
FIG. 19 is an elevational view, with some portions removed, illustrating how one forklift has tilted up the tilt table clear of the concrete panel, and another forklift has been operated to commence the removal of the concrete panel.
Figure 20:
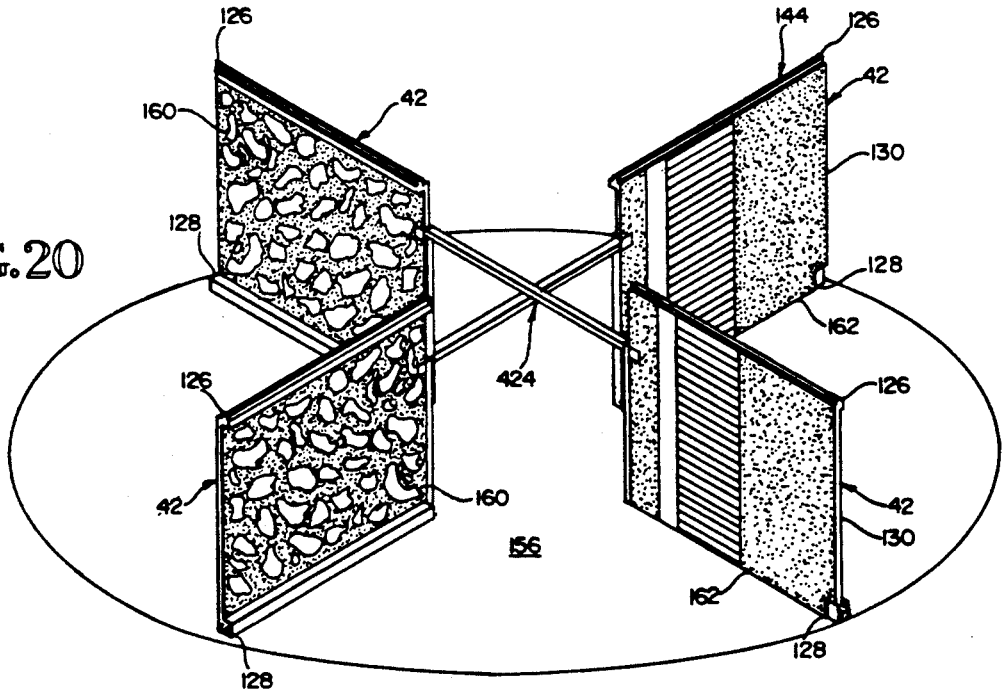
FIG. 20 is a perspective view showing how the removed concrete panels are supported in their vertical positions.
Figure 21:
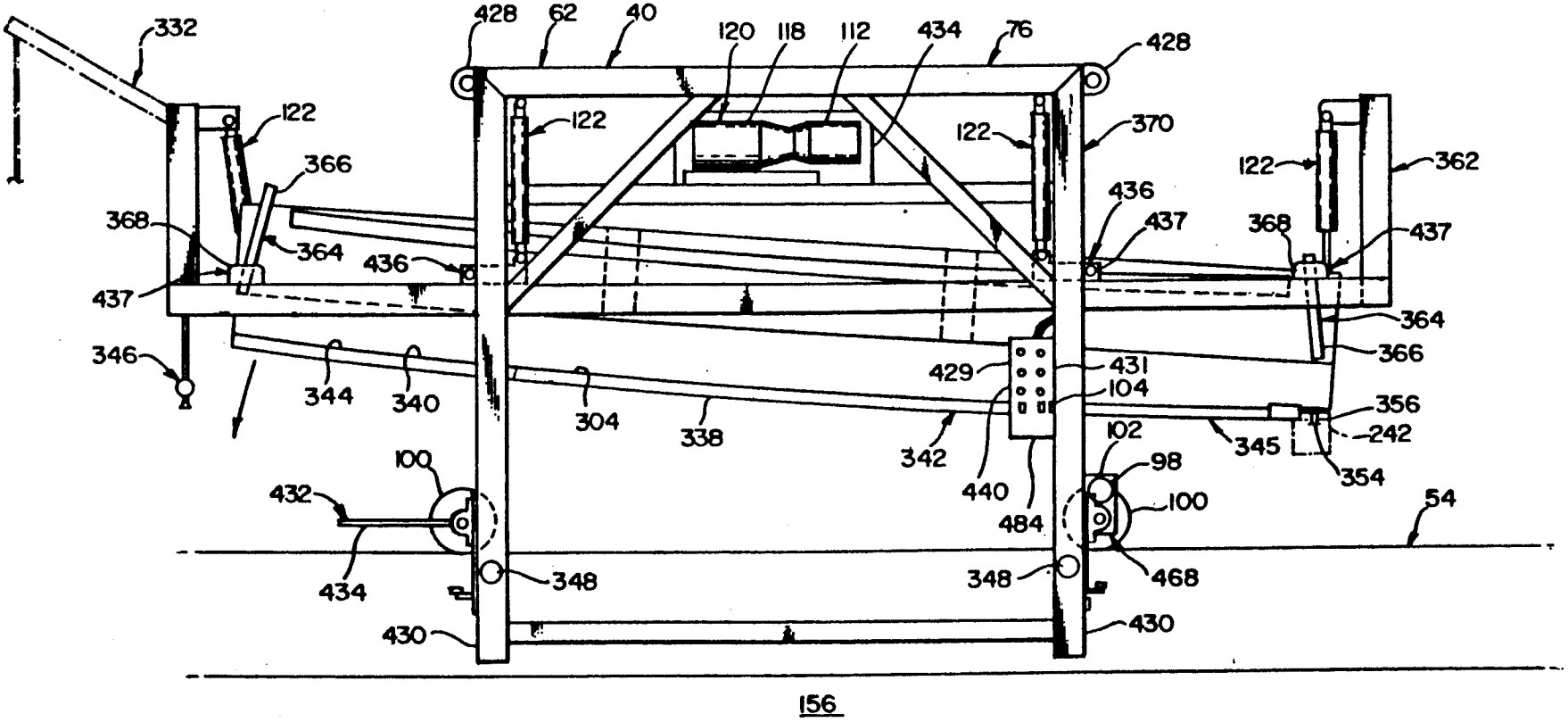
FIG. 21 is a side elevational view, with some portions removed, of the stamp cart and the stamp assembly thereof.
Figure 23:
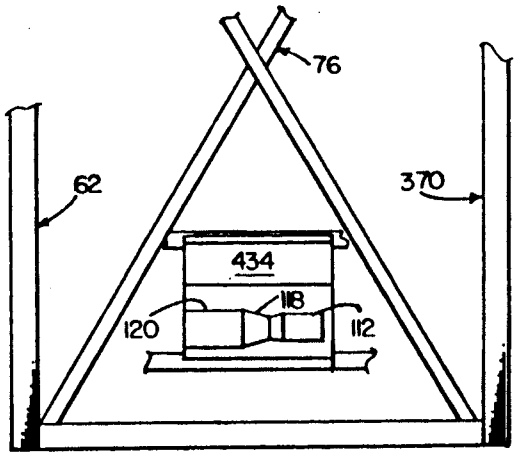
FIG. 23 is a partial top view of the stamp cart to further illustrate the arrangement of the hydraulic system.
Figure 25:
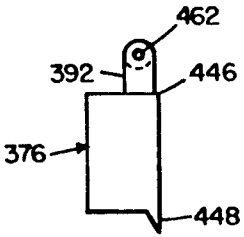
FIG. 25 is an end elevation of an inside back rail, illustrated in FIG. 24.
Figure 22:
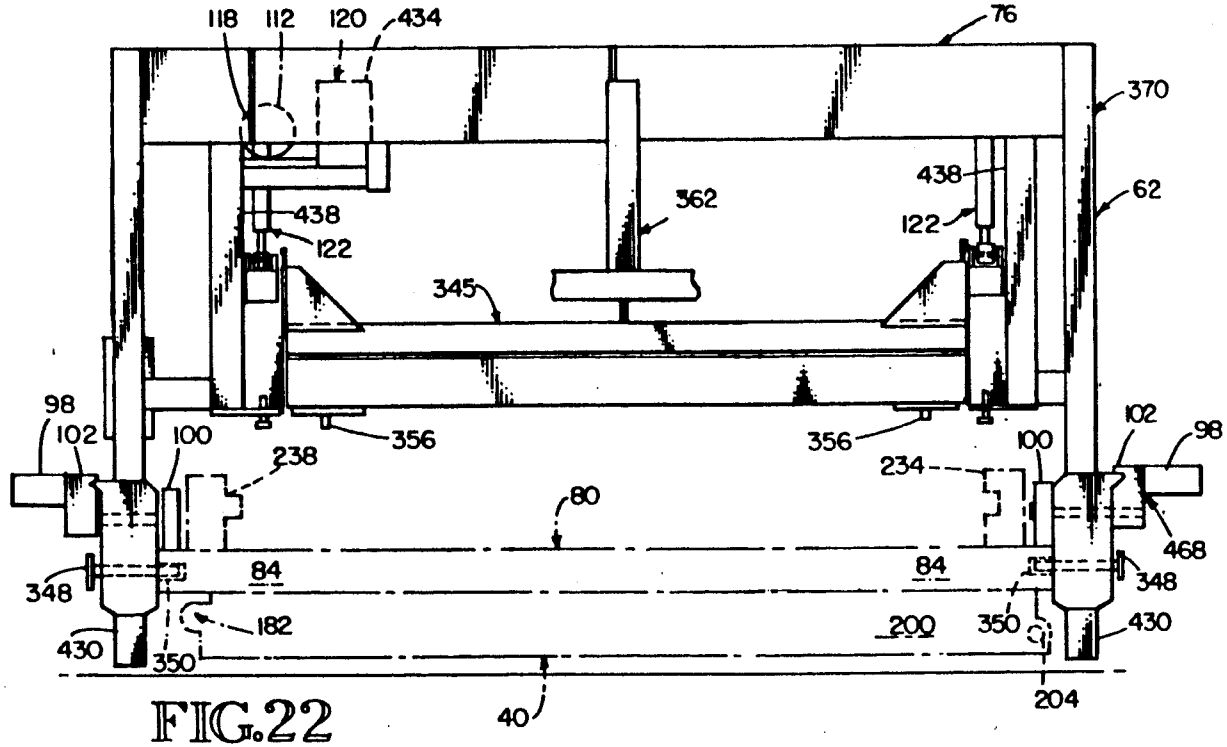
FIG. 22 is a front elevational view of the stamp cart and stamp assembly therefore, shown in FIG. 21, with some portions removed.
Figure 24:
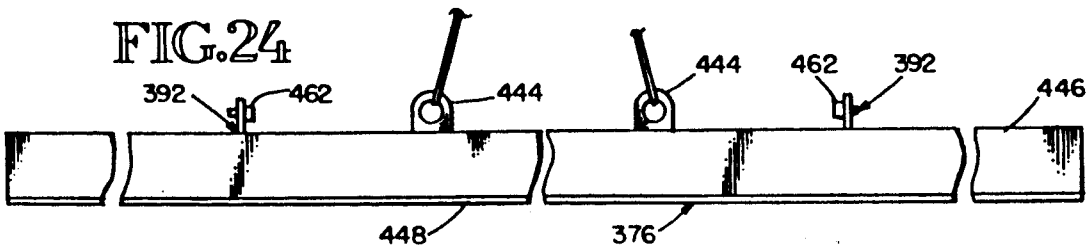
FIG. 24 is a longitudinal elevational view of an inside back rail with portions removed.
Figure 26:
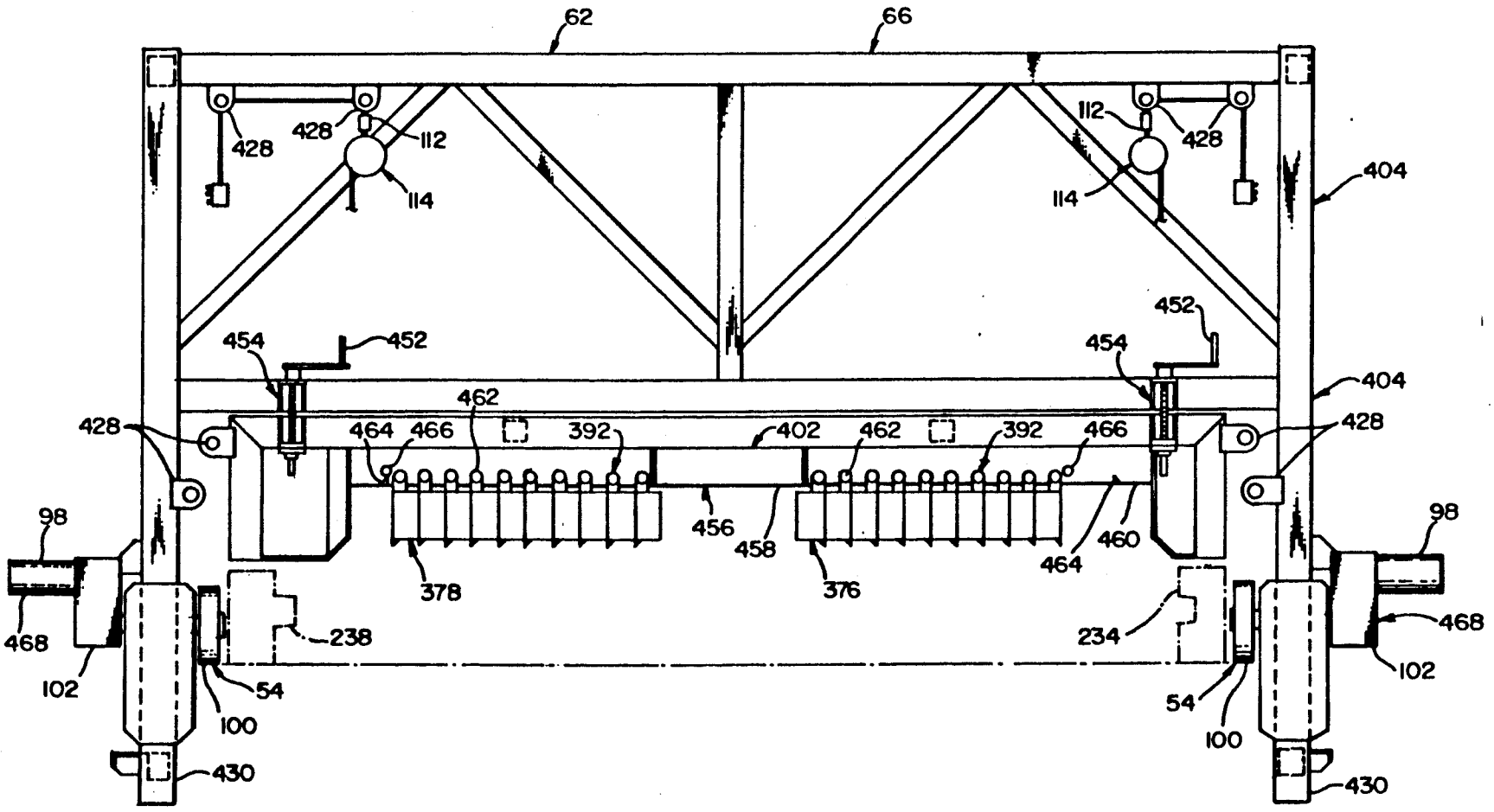
FIG. 26 is a transverse elevational view of the inside back rail cart.
Figures 27, 28, 29:
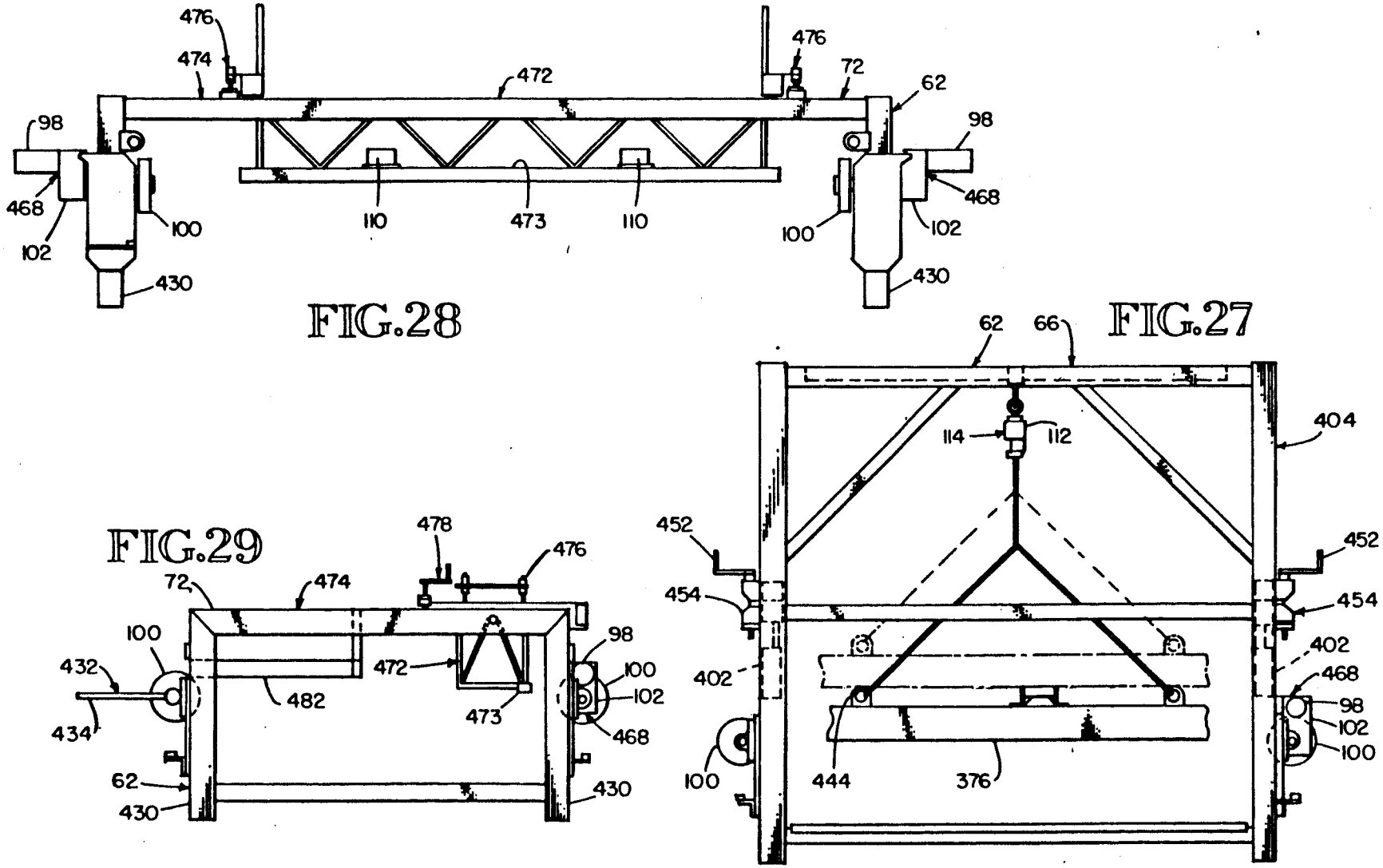
FIG. 27 is a side elevational view of the inside back rail cart.
FIG. 28 is a transverse elevational view of the vibrating screed cart.
FIG. 29 is a side elevational view of the vibrating screed cart.
Figure 32:
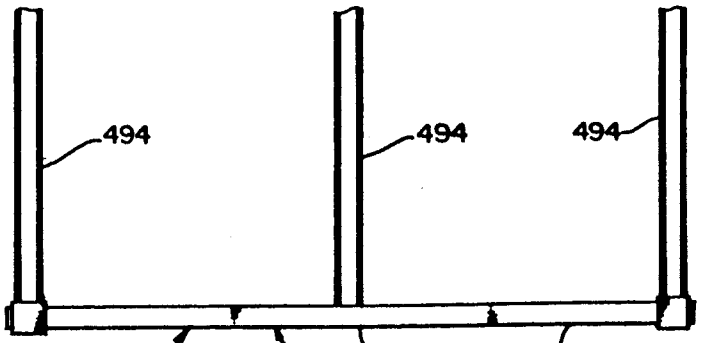
FIG. 32 is a partial top view of either the rebar cart or the wire mesh reinforcing cart.
Figure 31:
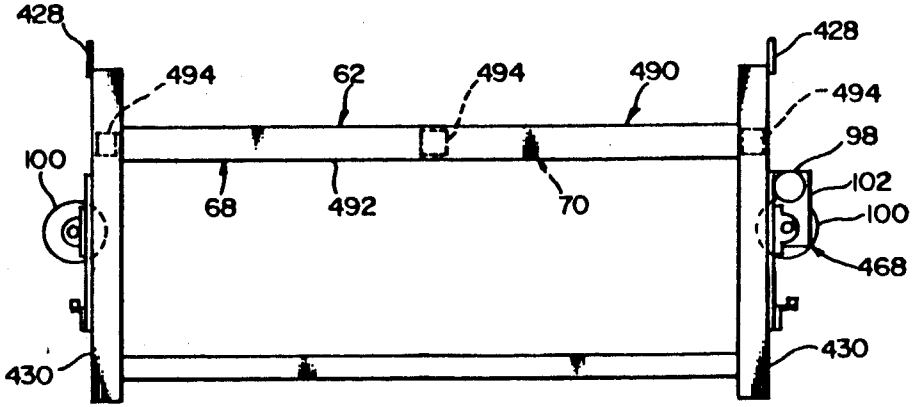
FIG. 31 is a side elevational view of either the rebar cart or the wire mesh reinforcing cart.
Figure 30:
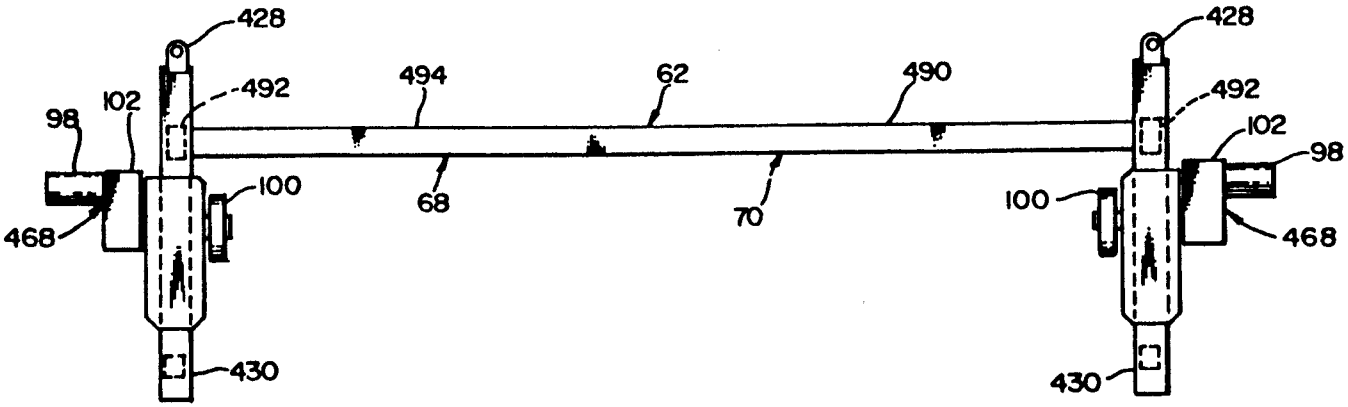
FIG. 30 is a transverse elevational view of either the rebar cart or the wire mesh reinforcing cart, which are identical and interchangeably used.
Figure 35:
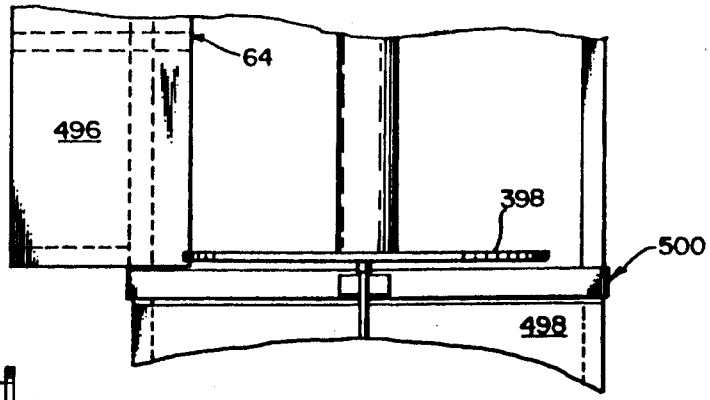
FIG. 35 is a partial top view of the tarp cart.
Figure 33:
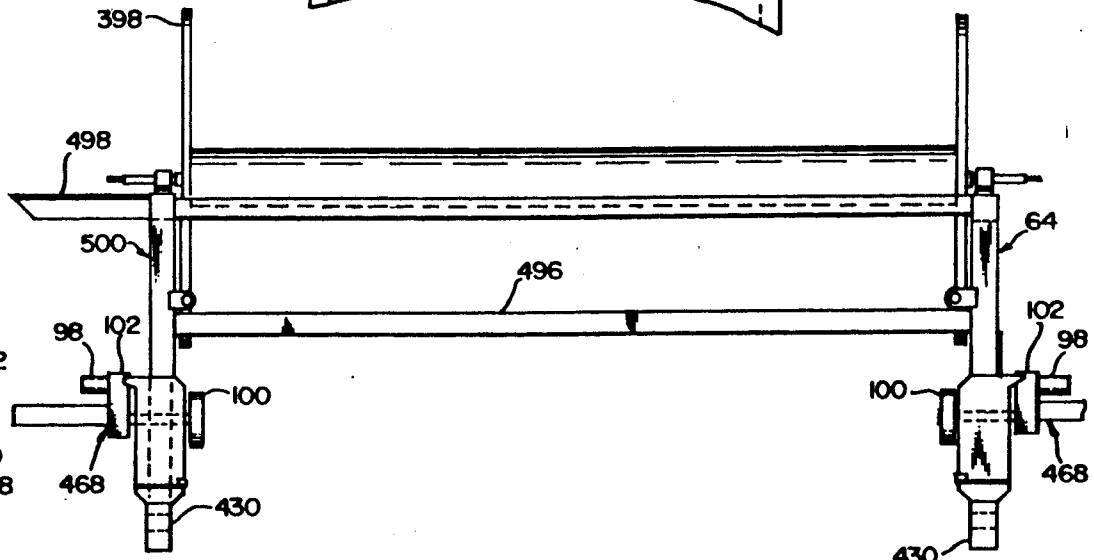
FIG. 33 is a transverse elevational view of the tarp cart.
Figure 34:
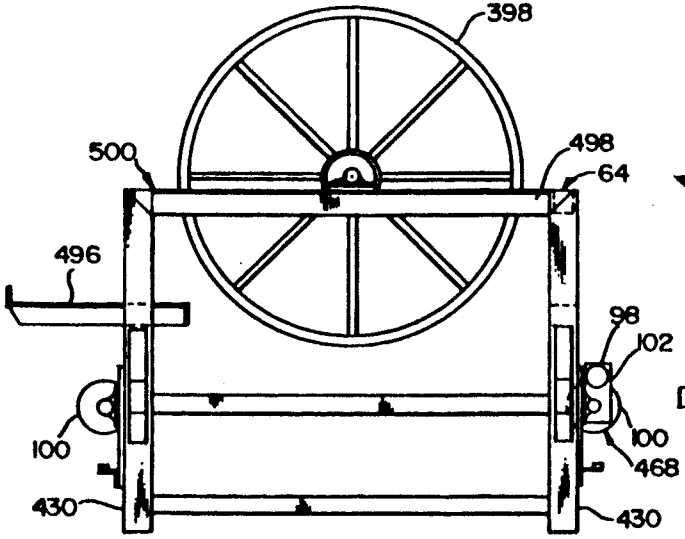
FIG. 34 is a side elevational view of the tarp cart.
Figure 36:
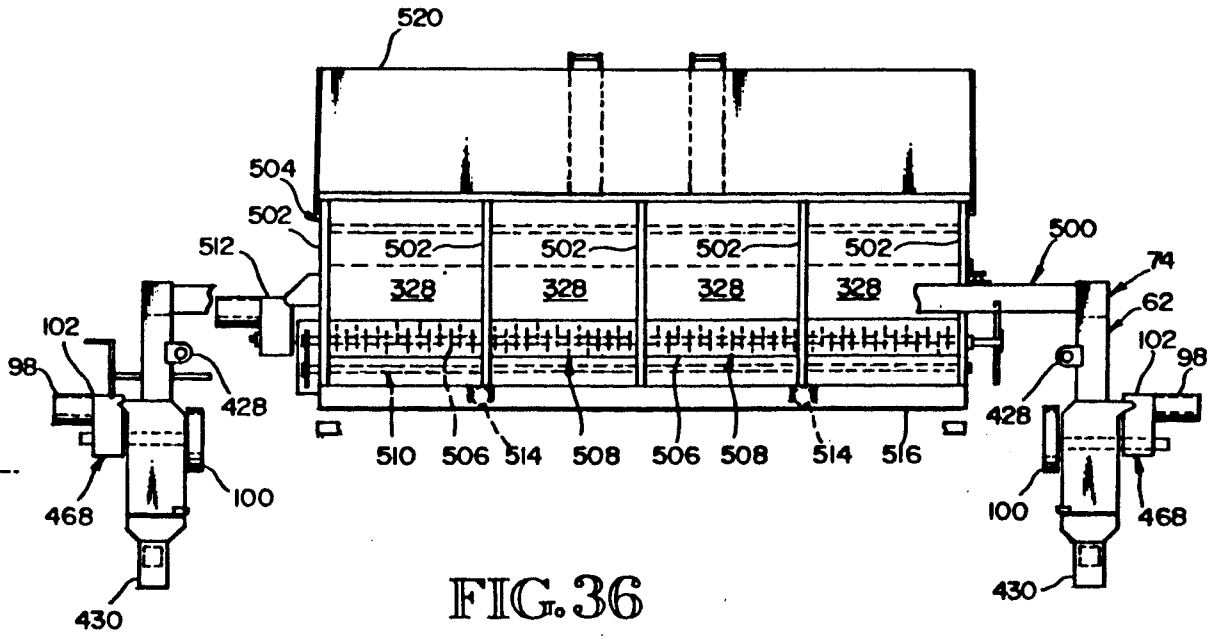
FIG. 36 is a transverse elevational view of the powder cart.
Figure 37:
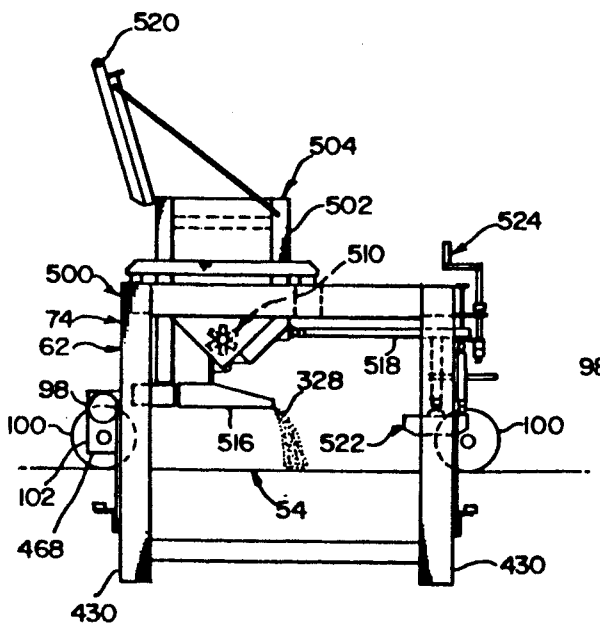
FIG. 37 is a side elevational view of the powder cart.

The overall production line equipment operated to produce many large concrete panels, in respect to a preferred embodiment thereof, utilized to produce a preferred embodiment of a concrete panel, thereafter installed with other like concrete panels to form a sound barrier alongside a vehicle way, is illustrated in the drawings, wherein:

FIG. 1 is a top view of the overall product line equipment, before concrete panels have been poured, illustrating the end to end arrangement of like tiltable assemblies of form components, inclusive of tracks, which are respectively used in making a specified concrete panel to be erected with others to form a sound barrier, and also showing how the tracks extend beyond these like tiltable assemblies of form components to continue to receive and to guide various carts, receiving electrical power for operating their motors, associated hand held electrical contacts made with a continuous electric T-track power supply, extending alongside the overall tracks;

FIG. 2 is a side view of the overall production line equipment shown in FIG. 1;

FIG. 3 is a side view of the preferred concrete panel which faces a community;

FIG. 4 is a side view of the preferred concrete panel which faces a vehicle way;

FIG. 5 is a top view of the concrete panel, showing the respective tongue and groove edges;

FIG. 6 is a bottom view of the concrete panel showing an anchoring subassembly adapted to be later mated with a receiving subassembly anchored in a concrete footing;

FIG. 7 is a perspective partial view showing the start of the erection of a sound barrier made by using these concrete panels, with one panel in place, and another panel being lifted into place, and also indicating the respective bottom receiving subassemblies anchored in respective concrete footings;

FIG. 8 is a plan view, with some portions removed for illustration purposes, of a portion of the extended tracks, and of the adjacent first one of several like tilt table assemblies, and the pivotal mountings and foundation thereof, indicating portions of the overall form assembly for a concrete panel, the track for the carts, and the separate location of the continuous electric T-track power supply system, supplying power to the electrical circuits and electric motors of the carts, and showing a portion of the second tilt table assembly;

FIG. 9 is an end or transverse elevational view, with some portions removed or shown in section for illustration purposes, of the first one of several like tilt table assemblies, and the pivotal mountings, and foundation thereof, also indicating the foldable braces used in keeping the tilt table at the tilted angle thereof, and showing the tilt arms to position the removed front rail of the form assembly, and showing other portions of the overall form assembly for a concrete panel, the track for the carts, and the separate location of the continuous electric T-track power supply system, supplying power to the electrical circuits and electric motors of the carts, and the steam pipe;

FIG. 10 is a partial plan view of a tilt table assembly showing the arrangement, with portions removed for illustration purposes, of the pre-oiled overall form assembly parts, including the front and back rails and top and bottom bulkheads, which are positioned to receive the poured concrete, with the top bulkhead having alignment holes and also indicating the placement of the cart delivered welded wire reinforcement at a spaced height resting upon small concrete spacers; the picks and their tension bars for subsequent lifting of the completed concrete panels; the respective cart delivered reinforcement steel assemblies for the pilasters; the cart delivered anchor bolts located with respect to one of the pilasters and extending in part, at a gaged length, through and beyond the bottom bulkhead; and the cart delivered jig steel reinforcement in respect to the other of the pilasters;

FIG. 11 is a partial sectional view of the tilt table assembly, taken on line 11—11 of FIG. 10, illustrating the arrangement of many of the various components illustrated in FIG. 10, and indicating the level of the first pour of concrete, by using phantom lines, which is delivered by a cement truck and the accessories thereof, and is thereafter vibrated and then screeded to this first level, upon operating the screed vibrating mechanism on the screed cart;

FIG. 12 is a partial plan view of the tilt table assembly, similar to FIG. 10, illustrating, however, how the top surface portions of the first concrete pour appear with a design thereon, after they have been vibrated; screed, upon operating the screed vibrating mechanism on the screed cart; colored by pigments delivered and spread by the color spreader cart and/or by hand; sprayed with a curing compound/bond breaker liquid; and stamped, upon operation of the rockable convex curved rubber or rubber like equipped stamp, which is carried, raised, lowered, and rocked, by operating the mechanisms of a stamp cart;

FIG. 13 is a partial plan view, indicating how optionally, a color template is selectably placed over some surface portion of the first pour of concrete, generally before the stamping of a design has occurred, but also elective occurring afterwards, to prevent some color pigments from reaching this covered surface, thereby creating an additional cross band coloring design, or other coloring design, on the finished concrete panel;

FIG. 14 is a perspective view of portions of the screed assembly, and, showing how, at selected times, a bull float is used to float a base color or colors into the surface portions of a concrete panel, and also showing how, when necessary, a small internal vibrator is used to eliminate rock pockets and voids, especially where a pilaster is being formed;

FIG. 15 is a partial sectional view of the tilt table assembly, at the location of line 15—15 of FIG. 12, showing, however, the additional placement of one of the respective inside back rails of the form assembly, which were delivered by the back rail cart, and indicating the level of the combined first and second pours of concrete in the pilasters, by using phantom lines, which were delivered by cement trucks and the accessories thereof;

FIG. 16 is a partial plan view of a tilt table assembly, and the form assembly, after the second pour of concrete has been undertaken, and the form assembly is still in place, showing the smooth surface portions of the pilasters, after the second pour of concrete, and indicating the design configurations on the community side of the concrete panel, which were stamped in the top surface portions of the first concrete pour, upon movements of the rockable convex curved rubber or rubber like equipped stamp, which is carried, raised, lowered, and rocked, by operating the mechanisms of a stamp cart;

FIG. 17 is a partial end view of a tilt table assembly and the form assembly, after the second pour of concrete has been undertaken, showing a cross section of a tarp, which has been continuously draped over many spaced support bows, positioned between back rails, throughout the length of all the tilt tables, on which a concrete panel with integral pilasters has been poured, to create an enclosure to confine steam, entering from a manifold, which is heating the previously poured concrete to cure it faster during a night period, so the forms may be stripped early during the following morning;

FIG. 18 is a partial plan view of a tilt table assembly and the form assembly, after the second pour of concrete has been undertaken and cured sufficiently, so the form assembly has portions thereof removed clear of the concrete panel with the inside back rails having been unbolted and removed by operating the lifting and tray storage mechanisms of the back rail cart; the top and bottom bulkheads having been unbolted and relocated by hand operations on the tilt table, a few inches away from their concrete pouring positions and bolted in these removed locations; the back rail having been unbolted, cleared away by hand, and arranged close by to be ready, via the lifting eye structures thereof, to be lifted upwardly by a forklift, when the tilt table is subsequently tilted upwardly; and the front rail having been unbolted, and moved to be held by the tilt arms, which have been removably bolted to the front of the tilt table at the deck elevation thereof, in preparation for the tilting of the tilt table; and showing the positioning of the tilt brackets, which have been removably bolted to the front of the tilt table at the deck elevation thereof, in preparation for the tilting of the tilt table, to create a center of rotation for the concrete panel, when lifted by a forklift, which insures the rotation thereof clear of the rubber of rubber like liner, which has the art design on it, creating the design on the vehicle way side of the concrete panel;

FIG. 19 is an elevational view, with some portions removed, illustrating how one forklift has tilted up the tilt table, with most of the form assembly in its relative position, yet spaced clear of the concrete panel, which has been operated to commence the removal of the concrete panel, and during this operation the foldable braces on the tilt table have been moved into their bracing positions;

FIG. 20 is a perspective view showing how the removed concrete panels are supported in their vertical positions and further operations are undertake such as spraying water sealants on them;

FIG. 21 is a side elevational view, with some portions removed, of the stamp cart and the stamp assembly thereof, showing also portions of the tilt table to indicate the rails thereof on which the wheels of the stamp cart travel, and further illustrating the electrical motor drive mechanisms, the manual ratchet drive mechanisms, the hydraulic system and the hydraulic actuators thereof, and the respective indexing pin structures, also illustrating, in phantom lines, the hoisting assembly used in handling a color template;

FIG. 22 is a front elevational view of the stamp cart and stamp assembly therefore, shown in FIG. 21, with some portions removed, and also showing, in phantom lines, portions of the tracks and other components of the tilt table, and form portions, and further illustrating how two electric drive motors, each with reduction gears, are utilized, and showing how the respective indexing pin structures are used, with one set of pin structures being used to locate the stamp cart at a specific location, where pin structure receiving holes are located, along the rails of the tilt table, and another set of pin structures being used to locate the stamp frame of the stamp assembly at a specific location in respect to the front end bulkhead form of the form assembly, which has pin structure receiving holes, whereby the rocking motion of stamp imprinting always occurs at the overall designated location on the surface portions of the poured concrete panel;

FIG. 23 is a partial top view of the stamp cart to further illustrate the arrangement of the hydraulic system in reference to a tank, an electric motor, and the hydraulic pump, driven by the electric motor;

FIG. 24 is a longitudinal elevational view of an inside back rail with portions removed, showing the location of lifting units and also the location of rollers, which are respectively used to lift the back rails by the mechanisms on the back rail cart and rollably store these ten back rails across one of the removable frame supports of the back rail cart;

FIG. 25 is an end elevation of an inside back rail, illustrated in FIG. 24, showing the location of the rollers, which are used in storing the back rail on one of the removable frame supports of the back rail cart;

FIG. 26 is a transverse elevational view of the inside back rail cart, illustrating the storing of back rails on one of the two same sized removable frame supports, which holds one half of the back rails, indicating the securement of the frame support, and the initial and final securement of the group of ten back rails;

FIG. 27 is a side elevational view of the inside back rail cart, illustrating the raising and then storing of the back rails, using a hoist and accessories thereof, which are supported by the frame of the back rail cart;

FIG. 28 is a transverse elevational view of the vibrating screed cart;

FIG. 29 is a side elevational view of the vibrating screed cart;

FIG. 30 is a transverse elevational view of either the rebar cart or the wire mesh reinforcing cart, which are identical and interchangeably used;

FIG. 31 is a side elevational view of either the rebar cart or the wire mesh reinforcing cart;

FIG. 32 is a partial top view of either the rebar cart or the wire mesh reinforcing cart;

FIG. 33 is a transverse elevational view of the tarp cart;

FIG. 34 is a side elevational view of the tarp cart;

FIG. 35 is a partial top view of the tarp cart;

FIG. 36 is a transverse elevational view of the powder cart which distributes color pigment powder; and FIG. 37 is a side elevational view of the powder cart.

DESCRIPTION OF THE PREFERRED EMBODIMENT

General Arrangement at an Outdoor Manufacturing Site

The overall production line equipment 40 utilized in producing many large concrete panels 42, in an initial horizontal position, during each day of many operational days is shown in FIGS. 1 and 2. The later illustrated large concrete panels 42, are installed vertically with other like panels 42 to form a sound barrier 44, extending alongside a vehicle way. Other large concrete panels to be used for other purposes, such as in buildings, may be manufactured using essentially the same production line equipment.

A large level area is selected, and, below ground level, using spaced large three foot diameter column-like forms 46, footings 48 are poured about various preselected anchor bolts 50 and/or plates 52 to support the production line equipment 40, which utilizes a fourteen foot wide track run 54 extending for five hundred and twenty feet or more. At each end of the track run 54, extending fifty feet or more are continuous track sections 56, supported on a frame assembly 58, in turn supported on the footings 48, which comprise the overall standby track sections 60.

During a production run, when the concrete panels 42 are produced, seven vehicles 62, a tarp cart 64, a back rail cart 66, a wire mesh cart 68, an identical rebar cart 70, a vibrating screed cart 72, a powder cart 74, and a stamp cart 76, are moved along the track run 54. When these vehicles 62 are not being used, they are moved to one or the other of the standby track sections 60. The remaining sections of the track run 54 are incorporated in each of the tilt table assemblies 80, which have a back rail side track section 81 and a front rail side track section 82. In this illustrated embodiment of the overall production line equipment 40, twenty tilt table assemblies 80 are utilized, which are twenty feet long and fourteen feet wide. They are also supported on footings 48 and they incorporate their own frame assembly 84.

Electrical Power is Available Throughout the Track Run of the Production Line Equipment The electric T-track power system 86 shown in FIGS. 1 and 2, and subsequent figures of the drawings, is utilized in a somewhat similar manner to the utilization of a bridge crane power system. Via a continuous uninterrupted electrical power take off T-track 88 of this power system 86, two hundred forty volt three phase power is available throughout the overall production line equipment 40. A steam shield skirt 90 protects this power system 86 from steam used during the curing of the concrete panels 42, and from damage possibly caused by other happenings. The electrical power delivered to the vehicles 62, i.e. carts, via their respective track following electric power pick up units 92, moving along the continuous conductors 94, is distributed via vehicle circuitry 96: to electric propulsion motors 98 on the vehicles 62 to drive wheels 100, via reduction gears 102, on all the vehicles 62; to electrical power outlets 104 into which electrical power cords 106 of many types of hand held tools 108 are inserted on substantially all the vehicles 62; to electrical powered vibrators 110; and to electrical motors 112 powering hoists 114, and hydraulic pumps 118 of hydraulic systems 120, which include hydraulic actuators 122.

The Large Concrete Panels, Inclusive of Their Integral Pilasters, Produced Upon Operating This Overall Production Line Equipment, are Used With Others to Form a Sound Barrier Alongside a Vehicle Way On each one of the selected twenty tilt table assemblies 80, illustrated in FIGS. 1 and 2, a large concrete panel 42, shown in FIGS. 3, 4, 5, 6, and 7, having integral pilasters 126, 128 formed at each side of an integral central planar body 130, is made of poured concrete, via two pours, which controllably flows, as shown in FIGS. 11 and 15, about well placed wire mesh reinforcing 132, referred to as wire mesh 132; reinforcing bars 134, referred to as rebars 134; anchor bolts 136; reinforcing bars 134 and rods 138 prearranged as pilaster reinforcement assemblies 140, 142; pick assemblies 144 with their tension bars 146 used first, in respect to one side group of them 148, in handling the large concrete panels 4, when they are removed from the tilt table assemblies 80, by further utilizing later attached clutches 150, which are components of a forklift assembly 152; and then used later in respect to another top group 154 in another place, in handling the large concrete panels at both the production site 156 and the installation site 158.

The community view side 160 of the large concrete panel 42 is illustrated in FIG. 3. The vehicle way view side 162 of the large concrete panel 44 is shown in FIG. 4. The tongue edge 164 and the groove edge 166 of each concrete panel 42 is observable in FIGS. 5 and 6. Also the anchoring subassembly 170 of the concrete panel 42 is illustrated in FIG. 6. As shown in FIG. 7, this anchoring subassembly 170 is interconnected with a respective receiving subassembly 172, which is anchored in a respective concrete footing 174 at the installation site 158, during the erection of the sound barrier 44.

The First Tilt Table Assembly in Relation to the Standby Track Section and the Second Tilt Table Assembly In FIG. 8, the arrangement of the first tilt table assembly 80 is shown in respect to adjacent portions of the standby track section 60 and to adjacent portions of the second tilt table assembly 80. Each tilt table assembly 80 has a back rail side track section 81 and a front rail side track section 82 to continue on the track run 54 throughout the length of the overall production line equipment 40.

The frame 58 of the standby track section 60 and the frame assembly 84 of the tilt table assembly 80 are supported on footings 48, made by pouring concrete into below ground level arranged portions of large diameter column forms 46. Anchor bolts 50 with plates 52 are used to secure the frame 58 of the standby track section 60.

In respect to the tilt table assembly 80, the frame assembly 84 thereof is pivotally secured, in reference to the front rail side 180 thereof, by hinge assemblies 182, with portions thereof respectively secured to bearing plates 188 of footings 48, and to portions 184 of the frame assembly 84 of the tilt table assembly 80. The back rail side 186 of the frame assembly 84 of the tilt table assembly 80 rests on bearing plates 188, which are secured to respective footings 48, via anchor bolts 50.

Between the tilt table portions 190 of the adjacent tilt table assemblies 80, the respective frame assemblies 84 have extending portions 192 to support removable wood planks 194, upon which personnel walk and stand during the production of the large concrete panels 42.

The Tilting Components of the Tilt Table Assemblies

The tilting components, which function to permit the rotation of the tilt table assembly 80 are, in part, illustrated in FIG. 9, and the tilted position is shown in FIG. 19. The hinge assemblies 182, the bearing plates 188 held by anchor bolts 50, and supported on the respective footings 48, portions of the frame assembly 84 of the tilt table assembly 80, such as the transverse support beams 200 are located over the respective footings 48. At the back rail end 202 of each transverse support beam 200 is an integrally formed lifting eye 204, and at the front rail end 206 of each transverse support beam 200 is an integral bearing hole 208 to receive components of the hinge assembly 182.

When the tilt table assembly 80 is tilted, as shown in FIG. 19, to place the large concrete panel 42 in a position to be removed from the tilt table portion 190, the lifting eyes 204 receive rigging components 210 of a forklift assembly 152. During the operation of a forklift 212, when the tilt table portions 190 and the frame assembly 84 are tilted, the pivoting bracing arms 214, 216 of the bracing assembly 218, which is pivotally connected between the footing 48 and frame assembly 84, are moved into their in line bracing position and locked in place.

As illustrated in FIGS. 8 and 9, the transverse support beams 200 of the frame assembly 84 are integrally joined at their intersection with two longitudinal support beams 220, which extend the full length of the tilt table assembly, presenting their extending portions 192 of the frame assembly 80, upon which a wood plank 194 is placed. These support beams 200 and 220 in turn support deck frame assembly 222, made of many spaced transverse members 224, extending across the longitudinal support beams 220 and connecting to the respective back rail side track section 81 and the front rail side track section 82.

The Form Assembly Supported on Tilt Table Assembly

The overall form assembly 230, as illustrated in FIGS. 9, 10 and 18, is composed of many parts, with some parts being somewhat permanently positioned for extended operating times and some parts being moved about in reference to each production run. Yet all of these parts are supported either directly or indirectly to the deck frame assembly 222, which in turn is supported on the transverse support beams 200 and longitudinal support beams 220 of the frame assembly 84 of the tilt table assembly 80.

A continuous steel plate 232, also referred to as the bottom liner 300, of this form assembly 230 extends entirely over the deck frame assembly 84. A back rail form 234 extends along the back rail side of the tilt table assembly 80, leaving only the width of the back rail side track section 81. On the concrete pour receiving side, this back rail form 234 has a longitudinal groove 236, to in turn receive the poured concrete, which upon curing is the tongue edge 164 of the large concrete panel 42. A front rail form 238 extends along the front rail side of the tilt table assembly 80, leaving only the width of the front rail side track section 82. On the concrete pour receiving side, this front rail form 238 has a longitudinal tongue 240, to in turn be surrounded by the poured concrete, which upon curing forms the groove edge 166 of the large concrete panel 42.

At the start of each tilt table assembly 80, the top end 241 receives the transverse top end form 242, also referred to as the fixed bulkhead 242, which has removable bulkhead portions 244, 246, also referred to as filler blocks 244, 246, to respectively form the top ends of the respective pilasters 126, 128 when the second pour of concrete occurs.

At selectable distances from the bottom end 248 of each tilt table assembly 80, a transverse bottom end form 252, also referred to as the movable bulkhead 252, is removably positioned. This form 252 also has removable bulkhead portions 254, 256, also referred to as filler blocks 254, 256, to respectively form the bottom ends of the respective pilasters 126, 128, when the second pour of concrete occurs.

These forms, the back rail form 234, the front rail form 238, the transverse top end form 242, and the transverse bottom end form 252, are all removably bolted to the tilt table assembly 80. The transverse top end form 242 and the transverse bottom end form 252 are fitted in between the back rail from 234 and the front rail form 238. The position of the transverse top end form 242 during the first pour of concrete is always at the same location. The position of the transverse bottom end form 252 is varied, when necessary, to meet respective specifications as to the heights of the completed large concrete panels 42, which are to be made during a particular production run.

The Bottom Liner of the Overall Form Assembly Combines Plywood and a Covering Rubber or Rubber Like Material, on Which a Design has Been Created, to In Turn Create During the First Pour of Concrete an Artistic Design on the Vehicle Way Side of the Large Concrete Panel The bottom liner 300 of the overall form assembly 230 is a combination of plywood 302 on which a rubber or rubber like material 304 is secured. A design 306 is created, generally by utilizing a molding process, in the rubber material 304. When the first pour of concrete is completed and cured, the large concrete panel 42 has this artistic design 306 on the side thereof, which will be facing toward a vehicle way, which is then referred to as the vehicle way side 162. This bottom liner 300 is removably secured to tilt table assembly 80 and positioned in the space between forms; back rail form 234, front rail form 238, transverse top end form 242, and the bottom end form 252.

The Placement of the Wire Mesh Reinforcing, Positioners Thereof; Reinforcing Bars; Anchor Bolts; Pilaster Reinforcing Assemblies, Pre-made of Reinforcing Bars and Reinforcing Rods: Groups of Pick Assemblies With Their Tension Bars As shown in FIGS. 10 and 11, the overall reinforcements 310 for the concrete 312, are positioned before the first pour of concrete. They are delivered by using the wire mesh cart 68 and the rebar cart 70. The carts 68, 70 are identical and used interchangeably with wire mesh reinforcing 132, or reinforcing bars 134, also called rebars 134; with combinations thereof; and with pre-made pilaster reinforcing assemblies 140, 142, made of reinforcing bars 134, reinforcing rods 138, and often also tieing wires 314.

The wire mesh reinforcing 132, also referred to as wire mesh 132, is positioned over the rubber material 304 and extended into the volumes, which later, when filled with concrete 312 become the pilasters 126, 128. The wire mesh 132 is spaced above the rubber material by using concrete positioners 316 at spaced locations. The respective pre-made pilaster reinforcement assemblies 140, 142, respectively, for the smaller cross section pilaster 126 and the larger cross section pilaster 128, are then positioned and secured, as necessary, by tieing wires 314. A pre-made assembly 318 of anchor bolts 136 is placed in the volume, which later, when filled with concrete 312, becomes the larger cross section pilaster 128.

During the production of a large concrete panel 42, along the back rail orientated tongue edge 164, places are provided so a forklift assembly 152 may be used to lift the large concrete panels 42 clear of the tilt table assembly 80. To create such places, pick assemblies 144 and their tension bars 146 are positioned before the first pour of concrete. Later, when a large concrete panel 42 is being moved either at the production site 156 or at the installation site 158, places are also needed so a forklift assembly 152 may be used to lift the large concrete panel 42 Therefore pick assemblies 144 and their tension bars 146 are positioned, before the first pour of concrete, so they will be in the top portion of the concrete panel 42.

The First Pour of Concrete

When the overall reinforcements 310 for the concrete are in place, as illustrated in FIGS. 10 and 11, then a ready-mix concrete truck 322, with the concrete distributing accessories 324 thereof, is operated to complete the first pour of concrete to the level indicated by the phantom lines in FIG. 11. During this first pour, personnel are also distributing, leveling, and vibrating the wet concrete. Hand held vibrators 326 are operated, especially to insure the concrete flows into the pilaster volumes, as illustrated in FIG. 14. As soon as possible, the operating vibrating screed cart 72, shown in FIGS. 1, 2, 14, 28 and 29, is advanced over the wet concrete to create a smooth, level surface of this first pour of concrete.

The Application of Color Pigments in Powder Form and Optionally Using a Color Template, and a Bull Float After the operating vibrating screed cart 72, shown in FIGS. 1, 2, 14, 28 and 29, has been advanced over the wet concrete, color pigments in powder form 328 are distributed by operating the power cart 74, shown in FIGS. 1, 2, 36 and 37, and, as necessary, also by hand. Before this first distribution of powder 328, or after this first distribution of powder and before the selected hand distribution of additional powders of other color pigments used for contrast, a color template 330 or color templates 330 may be placed to keep the additional contrasting color powders from reaching selected surface areas of the wet concrete as shown in FIG. 13. Preferably the color template 330 is lowered and lifted by using a hoisting assembly 332, preferably mounted on the front of the stamp cart 76 as shown in FIG. 21. After the first distribution of powder 328, and possibly at other times, a bull float 336 is optionally used to float the color into the wet concrete and therefore into the large concrete panel 42, as shown in FIG. 14.

Creating a Design in the Wet Concrete and Therefore in the Large Concrete Panel by a Rocking Stamping Operation After the surface of the wet concrete has been leveled and colored, a design is created as shown in FIGS. 3, 12, 13, and 18. Earlier a rubber or rubber like material 304 has been molded over a pattern of a design. Then this rubber like material 304, with the design 338, is secured to a backing 340, and this stamp design assembly 342 is removably secured to the curved convex bottom 344 of the rocking frame 345 of the stamp cart 76, as shown in FIGS. 21 and 22.

The stamp cart 76 is equipped with a front located spraying assembly 346, which is turned on, as the stamp cart 76 is moved over the tilt table assembly 80, to spray a curing compound and bond breaker onto the wet colored surface of the first pour of concrete. After completing the spraying, the stamp cart 76 is positioned at a definite predetermined location by inserting the locating pins 348 thereof into locating receiving holes 350 formed in the frame assembly 84 of the tilt table assembly 80.

Also locating receiving holes 354 are formed in the transverse top end form 242, also referred to as the fixed bulkhead 242. These receiving holes 354 receive depending locating pins 356, which are positioned and secured to the rocking frame 345. When all the locating pins 348 and 356 are in their respective locating receiving holes 350 and 354, the stamp cart hydraulic system 120, which has been previously operated to lower a vertical movement frame 362, and to adjust the rocking frame 345, so the depending locating pins 356 are in the locating receiving holes, is operated again to rock the rocking frame 345 of this stamp cart 76, shown in FIGS. 21 and 22, to create the design in the wet concrete, and therefore in the large concrete panel 42.

A precise and repeatable rocking movement of the rocking frame 345 occurs, because of the utilization of cam assemblies 364 having guide bars 366 on the rocking frame 345, and adjustably positioned guide rollers 368 on the vertical movement frame 362. The vertical movement frame is movably guided by portions of a main frame 370 of the stamp cart 76. Hydraulic actuators 122 move the vertical movement frame 362 relative to the main frame 370, and hydraulic actuators 122 move the rocking frame 345 relative to the vertical movement frame 362.

Placement of the Inside Back Rails, and the Removable Bulkheads, Called Filler Blocks to Complete the Poured Concrete Receiving Volume of the Pilasters As illustrated in FIGS. 15, 16, and 17, inside back rails 376, 378 for the respective back rail side 186 and the front rail side 180 of the tilt table assembly 80 are secured in place. Also the removable bulkheads 244 and 246,, shown removed in FIG. 18, also called filler blocks, of the transverse top end form 242, and the removable bulkheads 254, 256, shown in FIG. 15, and shown removed in FIG. 18, also called filler blocks, of the transverse bottom end form 252 are secured in place. The poured concrete receiving volumes of the pilasters 126, 128 are then completed. Preferably, as shown in FIG. 15, by phantom lines, temporary removable pouring shields 382 are installed to keep any portions of the second pour concrete from reaching the stamped design on the face of the concrete panel, which was formed after the first pour of concrete.

Before this second pour of concrete is undertaken, preferably the location of the anchor bolts 136 is rechecked per specifications. Throughout the production process, the specifications for each large concrete panel 42 are available on a clip board 384 removably suspended from a tilt table assembly 80. For example, the selective placement of the transverse bottom end form 252, referred to as the movable bulkhead, is specified, so the correct height results of the specific large concrete panel being ordered on a given day.

The second pour is then undertaken to complete the pilasters 126, 128, with the ready-mix concrete being delivered by a truck 322 and the concrete distributing accessories 324 thereof. Hand directed powered internal vibrators 326 are used to vibrate this second pour concrete. Also hand floats and hand trowels, not shown, are utilized to create good surfaces on the pilasters 126, 128.

Steam Heat Curing Overnight of the Large Concrete Panels Under a Continuous Tarp Supported on Spaced Bows When production runs are to be undertaken again on the following day, steam heat curing overnight of the large concrete panels 42 is undertaken. As shown in FIG. 17, tarp support bows 388 at spaced locations are supported between the inside back rails 376, 378. The ends of the tarp support bows 388 are formed to have a notch 390, which fits over roller assemblies 392 mounted on the inside back rails. When these inside back rails 376, 378 are temporarily stored on the back rail cart 66, these roller assemblies 392 are utilized.

After the installation of the support bows 388 at spaced locations along the overall production line equipment 40, then the tarp cart is operated to unroll the tarp 394 over all the tarp support bows 388 and beyond, so all the large concrete panels 42 will be heated by the steam distributed through the steam pipe 396.

On the Following Day, the Removal of the Tarps and the Moving of Some Portions of the Overall Form Assembly Away From the Large Concrete Panel In the morning of the following day, the tarp cart 64 is operated for the electrical power advancement thereof, and is also operated for the hand powering of a reel 398 thereof, to remove the tarp 394 from the support bows 388 and the large concrete panels 42. Thereafter, the support bows 388 are removed from the inside back rails 376, 378.

Then some portions of the overall form assembly 230 are removed, as shown in FIG. 18, commencing with the operation of the back rail cart 66 and the hoists 114 thereof, to retrieve and to store the inside released back rails 376, 378 on removable frame supports 402, which are removably secured to the main frame 404 of this back rail cart 66. Then remaining form portions are released. Generally, all the securement of the movable portions of the overall form assembly 230 is undertaken by tightening bolt and nut fasteners 406 at several locations, being only shown at some places The transverse top end form 242, referred to as the fixed bulkhead, is cleared away a short distance and then re-secured to the tilt table assembly 80, to be readily available for the next use thereof. Likewise, the transverse bottom end form 252, referred to as the movable bulkhead, is cleared away a short distance and resecured to the tilt table assembly 80, to be readily available for the next use thereof.

The back rail form 234 is released and positioned nearby on the tilt table assembly 80, to be subsequently lifted upon the operation of a forklift assembly 152, when the tilt table assembly 80 is tilted, and thereafter lowered with it to be ready for the next use thereof. The front rail form 238 is released and positioned nearby on spaced tilt arms 410, which have just been secured, at this form removal operational time, to the front rail side of the frame assembly 84 of the tilt table assembly 80. They so remain supported by the tilt arms 410 during the tilting of the tilt table assembly 80. Following the return of tilt table assembly 80 to the horizontal position, the front rail form 238 is close by and ready for the next use thereof. When the front rail form 238 is resecured for the next first pour of concrete, the spaced tilt arms 410 are removed, clearing the way for the moving vehicles 62, serving the various cart functions.

Using Tilt Bracket Assemblies, Temporarily, During the Tilting of the Tilt Table Assembly and the Lifting of the Large Concrete Panel Clear of the Rubber Like Material and the Design Thereon Upon Operations of Forklift Assemblies Before the tilting of the tilt table assembly 80, tilt bracket assemblies 414 are secured to the frame assembly 84 of the tilt table assembly 80 to be ready to pivotally support the large concrete panels 42, as shown in FIG. 18. Later, when the tilt table assembly 80 is rotated upon operation of a forklift assembly 152, and thereafter another forklift assembly 152 is operated to remove the large concrete panel 42 from the tilt table assembly 80, as shown in FIG. 19, the large concrete panel 42 is rotated about a spaced away center of rotation, provided by the operations of the tilt bracket assemblies 414.

After the partial tilting of the tilt table assembly 80, clutches 150 are more conveniently secured to pick assemblies 144 located along the edge of the smaller cross section integral pilaster 126 at the back rail side of tilt table assembly 80. The second used forklift assembly 152, as shown in FIG. 19, is secured to these clutches 150, when the large concrete panel 42 is lifted clear of the tilt table assembly. Thereafter the tilt bracket assemblies 414 are removed.

Arranging the Large Concrete Panels at the Production Site Apart From the Immediate Overall Production Line Equipment for Further Processing and to Await Delivery As illustrated in FIG. 20, the large concrete panels 42 are moved and then positioned upright and so held by special supports 424 at the production site 156. In these upright positions, the pick assemblies 144 located at the tops of the large concrete panels 42 are ready for the temporary handling of these panels 42, in loading delivery trucks, and later handling these panels 42 at an installation site 158.

The Arrangement and Operation of the Stamp Cart

In FIGS. 21, 22, and 23, the arrangement of the stamp cart 76 is illustrated. This stamp cart 76, one of the seven vehicles 62 referred to as carts, operates, as all these vehicles do, throughout the length of the track run 54 of the overall production line equipment 40. If it is ever necessary to remove this cart 76, or any of the other carts, lifting pad eye structures 428 are provided to be connected to a forklift assembly 152. In addition, the main frame 370 of the stamp cart, and the main frames of all the vehicles 62, have four depending extending legs 430 which, after a vehicle 62 is lifted from the track run 54, make contact with the ground or other support. By having this arrangement, the wheels 100, reduction gears 102 and electric propulsion motors 98 of all the vehicles 62 are well spaced above ground level, when a particular cart is not positioned on the track run 54.

The electrical power distributed throughout the overall production line equipment, via the electric T-track power system 86, reaches the electrical propulsion motors 98, the vehicle circuitry 96, the vehicle transformer 429, electrical control box 431, the vehicle electric power outlets 104, the electric motor 112, which drives the hydraulic pump 118, as the electrical power pick up units 92, shown only in FIGS. 11 and 15, but which are on the stamp cart 76, which are like those on other carts, continuously contact the continuous conductors 94 of the two hundred and forty volt T-track 88. As necessary, when final alignments are being made to locate the stamp cart 76 at a temporary pinned location, relative to the frame assembly 84 of the tilt table assembly 80, manual ratchet drives 432 are operated, upon turning removable ratchet handles 434, to drive the wheels 100 on the stamp cart 76, which are not powered by the electric motors.

The main frame 370 extends upwardly sufficiently high to support a hydraulic oil tank 434, and an electric motor 112 to drive a hydraulic pump 118, so they remain clear of the vertical travel path of the vertical movement frame 362. This frame 362 is also referred to as the stamp upper frame 362. Adjustable rollable guide assemblies 436 which include adjustable eccentric cam roller units 437 are mounted on the vertical movement frame 362. They serve as followers, when they are moving up and down respectively along the near corner depending auxiliary frame members 438, which are integrally made with the main frame 370. These rollable guide assemblies 436 control the motion of the vertical movement frame 362, which is raised and lowered upon the operation of four hydraulic actuators 122, which are positioned between the top of the main frame 370 and the vertical movement frame 362.

Upon operation of some of the respective hydraulic controls 440 of the hydraulic system 120 on this stamp cart 76, the vertical movement frame 362 is raised upwardly out of the way, until the design stamping operation is to be undertaken. Then when the stamp cart 76 is moved and pinned at a respective stamping locale relative to the tilt table assembly 80, the hydraulic controls 440 are operated to lower the vertical movement frame 362 to the height, where the movement of the rocking frame 345 is effectively and accurately undertaken, when the design is created on the large concrete panel 46.

The rocking frame 345 is suspended from the vertical movement frame 362, also called the stamp upper frame 362, and it is also moved relative to this frame 362, by using two hydraulic actuators 122. The precise same rocking motion repeatedly results, because cam assemblies 364 are used at four places, in respect to these frames 345 and 362. Each cam assembly 364, has a guide bar 366 secured at a small angle to the rocking frame 345. This guide bar 366 moves up and down through an adjustable eccentric cam roller unit 437, which is adjustably positioned on the vertical movement frame 362.

Before the rocking frame 345 is fully operated to stamp the design into the wet concrete, it is initially moved downwardly at the end thereof, from which depending locating pins 356 are adjustably located.

Before the very first use of a stamp cart 76, the adjustable cam assemblies 364, the adjustable roller guide assemblies 436, and these adjustable depending locating pins 356, are all arranged, so these depending locating pins 356 will pass through locating receiving holes 354, in the transverse top end form 242, which is also referred to as the fixed bulkhead, of the overall form assembly 230. Thereafter all the adjustments are completed, upon tightening, and then, upon the repeated production use of the stamp cart 76, carrying the specified stamp design assembly 342, before each arcuate movement of the rocking frame 345, these depending locating pins 356 are first passed into the locating receiving holes 354, to thereby insure the specified design will be stamped in the correct position on the large concrete panel 42. Other hydraulic controls 440, of the hydraulic system 120 are operated to initiate and to control the movement of the rocking frame 345.

Preferably, when color templates 330 are to be used to cover portions of wet concrete of an adjacent large concrete panel 42 to keep color pigments from reaching the covered portions, a hoisting assembly 332 is mounted on the stamp cart. In FIG. 21 this hoisting assembly 332 is illustrated in phantom lines.

The Inside Back Rails Used in Completing the Forming of the Pilasters

In FIGS. 24 and 25 the inside back rails 376, 378 are illustrated in reference to one of them. In FIG. 24 the side of the inside back rail 376 is shown to indicate the location of the two lifting units 444, which are preferably pad eyes 444, and also to indicate the location of the roller assemblies 392. These units 444 and the assemblies 392 are used, when the inside back rail 376 or 378 is lifted to reach the removable frame supports 402 of the inside back rail cart 66, and thereafter be rolled in place thereon.

In FIG. 25, the end of the inside back rail 376 is shown, to indicate the location of the roller assemblies 392. Also shown in FIG. 25, is an upper triangular cross sectional longitudinal portion 446, which like others used elsewhere, is used to form chamfer edge portions on a pilaster 126 or 128. In addition, there is a lower larger triangular cross sectional longitudinal portion 448 to create a chamfer edge portion of the design structure adjacent to a pilaster 126 or 128.

The Arrangement and Operation of the Inside Back Rail Cart

The inside back rail cart 66, also referred to as the back rail cart 66, shown in FIGS. 26 and 27, has a removably bolted in place removable frame support 402. It is secured, upon turning the bolt handles 452 of respective fastener assemblies 454, to the main frame 404 of the inside back rail cart 66. Each removable frame support 402 holds ten inside back rails 376, 378. After ten inside back rails are loaded, the removable frame support 402 is removed by using a forklift assembly 152. Then another removable frame support 402 is secured to the inside back rail cart 66, and ten more inside back rails 376, 378 are lifted and rolled into place on the second removable frame support 402, as the inside back rail cart 66 is moved along the track run 54.

Each removable frame support 402 has two transverse eye beams 456 to receive in part the respective roller assemblies 392 of the inside back rails 376, 378. These beams 456 have the lower flange 458 thereof cut to create a notch 460 at each end to receive the wheels 462 of the roller assemblies 392 which are mounted on the inside back rails 376, 378. Each wheel 462 passes over a respective slight bump structure 464 on the lower flange 458, which serves to keep the inside back rails 376, 378 on the eye beam 456 during loading. After ten inside back rails 376, 378 are in place on the removable frame support 402, then complete end abutments 466 are threadedly advanced to block any wheel 462 from leaving either end of the lower flange 458 of the eye beam 456 of the removable frame support 402, before this support 402 is removed from the inside back rail cart 66. This securement keeps the inside back rails 376, 378 positively located on the removable frame support 402, when it is removed from the inside back rail cart 66.

The raising of an inside back rail 376, 378, is illustrated in FIG. 27, to reach the height of removable frame support 402, by using a hoist 114 secured to the main frame 404 of the inside back rail cart 66. The lower portions of the main frame 404 serve as extending legs 430, to support wheels 100, reduction gears 102, electrical propulsion motors 98, of an overall propulsion system 468, which is also used on all the various vehicles 62, referred to as respective carts, 64, 66, 68, 70, 72, 74 and 76.

The Arrangement and Operation of the Vibrating Screed Cart

As shown in FIGS. 14, 28 and 29, a vibrating screed assembly 472, having the vibrator structure 473, is pivotally and adjustably secured to a main frame 474 of the vibrating screed cart 72 by using a pivotal securement assembly 476 and by using hand cranked fastener assemblies 478 for height adjustments. The main frame 474 also supports a transverse personnel platform 482, an electrical control panel 484, and a one hundred and ten volt transformer 486. The lower portions of this main frame 474 serve as extending legs 430 to support wheels 100, reduction gears 102, and electrical propulsion motors 98 of an overall propulsion system 468, which is also used on all the various vehicles 62. The vibrating screed cart 72 is carefully moved along the track run 54, when the wet concrete of a large concrete panel 42 is being leveled and smoothed upon the operation of the vibrating screed assembly 472.

The Arrangement and Operation of the Rebar and/or Wire Mesh Reinforcing Cart

As shown in FIGS. 30, 31, and 32, the rebar and/or wire mesh reinforcing carts 68, 70 are used interchangeably to carry either reinforcing bars 134, referred to as rebars 134, or wire mesh reinforcing 132, referred to as wire mesh 132, or combinations of them. Also reinforcing rods 138, pilaster reinforcement assemblies 140, 142, anchor bolts 136 and anchor bolt subassemblies 170 are carried on these carts 68,70, referred to as rebar cart 70 and wire mesh cart 68.

The main frame 490 of either cart 68 or 70 has two alike spaced longitudinal members 492, one on each side, supporting three alike spaced transverse members 494, and all these members 492, 494 are arranged in the same horizontal geometric plane. The lower portions of this main frame 490 serve as extending legs 430 to support wheels 100, reduction gears 102, and electrical propulsion motors 98, of an overall propulsion system 468, which is also used on all the various vehicles 62, to move them along the track run 54.

The Arrangement and Operation of the Tarp Cart

When steam heat is to be relied upon to shorten the curing time of the large concrete panels 42, an overall tarp 394 is placed over these panels 42 during the night as shown in FIG. 17. The tarp cart 64, illustrated in FIGS. 33, 34, and 35, is powered along the track run 54 by using the overall propulsion system 468. It is like the same systems 468 used on all the various vehicles 62.

A large reel assembly 398 is mounted on this tarp cart 64, and personnel hand power this reel assembly 398 to unroll the overall tarp 394, while standing on a longitudinal platform 496. Other personnel, while standing on a higher positioned transverse platform 498, direct the overall tarp 394 as it leaves the large reel assembly 398. This same arrangement of personnel is followed when the overall tarp 394 is being removed from the large concrete panels 42 on the following morning, and rolled back onto the tarp cart 64.

There is a main frame 500, which supports the large reel assembly 398, and the personnel platforms 496, 498. Also the lower portions of the main frame 500 serve as extending legs 430 to support wheels 100, reduction gears 102, and electrical propulsion motors 98, of an overall propulsion system 468, which is also used on all the various vehicles 62 to move them along the track run 54.

The Arrangement and Operation of the Powder Cart

When color pigments in powder form are to be uniformly spread across the wet surface of a large concrete panel 42, then a powder cart 74 is used as shown in FIGS. 36 and 37. The main frame 500 has the lower portions, which serve as extending legs 430, to support wheels 100, reduction gears 102, and electrical propulsion motors 98, of an overall propulsion system 468, which is also used on all the various vehicles 62, to move them along the track run 54.

Five alike section sub frames 502 transversely spaced apart on the main frame 500 in turn support a transversely arranged powder receiving bin 504. The powders 328 of a color pigment are stirred by a driven rotating mixing multiple blade 506 shaft assembly 508, arranged transversely and centrally with respect to the receiving bin 504. The powder 328 is discharged at the bottom of the powder bin 504 upon the operation of the revolving transverse metering and dispensing shaft 510. A common electrical powered drive system 512 drives both the multiple blade shaft assembly 508 and the dispensing shaft 510. Vibrators 514 are mounted on some of the sub frames 502 to vibrate the powder bin 504 and the transverse powder distributing tray 516 positioned below the dispensing shaft 510.

A transverse platform 518 on the main frame 500 is used by personnel to open the lid 520 of the powder bin 504 and to load more powder, and to adjust the height of the transverse bull float 522, which is adjustably supported on the main frame 500, by the operation of the hand crank height adjusting assemblies 524.

The Overall Utilization of the Vehicles Arranged in Different Cart Embodiments for Specific Production Purposes for Their Operation on the Track Run By using these vehicles 62, powered on the track run 54, arranged as the various carts, tarp cart 64, inside back rail cart 66, wire mesh cart 68, rebar cart 70, vibrating screed cart 72, the powder cart 74 and the stamp cart 76, the large concrete panels 42 are conveniently, efficiently and economically manufactured by utilizing this overall production line equipment 40. There are limited production times when forklift assemblies 152 are utilized. Also there are limited production times when personnel must lift members of substantial weight, and/or move them very far.

By using the precision operated stamp cart, excellent appearing designs are accurately made in the wet surface portions of the large concrete panels 42. These designs on the community view side 160 are pleasantly observable by the dwellers of homes and business buildings, which are separated from the vehicle ways by the sound barriers 44, consisting of these large concrete panels 42, which have their integral pilasters 126, 128.

Moreover, each large concrete panel 42, has an attractive design on its vehicle way side 162. Also each of these designs on either side, may be reasonably conveniently changed in respect to future formed large concrete panels 42. In addition these panels with having their integral pilasters 126, 128, having in turn the respective tongue 164 and groove 166 edges, with having their anchoring subassembly 170, and with having their lifting assist pick assemblies 144, are all equipped for convenient and efficient handling during their erection at the sound barrier installation site 158 as shown in FIG. 7.

I claim:

1. Production line equipment to produce large concrete panels having designs formed in the surfaces thereof, comprising:

a. an overall form assembly to receive poured concrete creating a large concrete panel;

b. a main frame positioned over the overall form assembly;

c. a rocker frame movably suspended from the main frame;

d. a stamp design assembly secured to the rocker frame; and e. actuators connected between the main frame and the rocker frame to move the rocker frame, carrying the stamp design assembly, to create a design in a recently poured large concrete panel.

2. Production line equipment, as claimed in claim 1, comprising, in addition, depending pins on the rocker frame and receiving holes therefor in the overall form assembly to initially position the rocker frame relative to the overall form assembly, always at the same location, to thereby insure the stamp design assembly will always be rocked in the same locale.

3. Production line equipment, as claimed in claim 2, comprising, in addition, transverse pins on the main frame and receiving holes in the overall form assembly to initially position the main frame relative to the overall form assembly, always at the same location, to thereby insure the subsequent operations to position the rocker frame will commence at the same starting location, and also to insure the transfer of the static and dynamic forces between the rocker frame, the main frame, and the overall form assembly, before, during, and after the operation of the rocker frame when a design is made in the surface portions of the wet concrete.

4. Production line equipment, as claimed in claim 3, comprising, in addition, a vertical movement frame interconnected between the main frame and the rocker frame, to move the rocker frame up and down.

5. Production line equipment, as claimed in claim 4, comprising, in addition, actuators connected between the vertical movement frame and the main frame, and then the first actuators are reconnected to be connected between the vertical movement frame and the rocker frame.

6. Production line equipment, as claimed in claim 5, comprising, in addition, cam assemblies mounted on the vertical movement frame, and guide bars mounted on the rocker frame to move, when guided by the cam assemblies, in a repeated like motion, whereby the rocker frame in turn moves in repeated like motions and the stamp design assembly creates the design always in the designated place on a recently poured large concrete panel.

7. Production line equipment, as claimed in claim 6, comprising in addition, guide rollers on the vertical movement frame for rolling on the main frame during the raising and lowering of the vertical movement frame relative to the main frame.

8. Production line equipment, as claimed in claim 7, comprising, in addition, a stamp cart having a frame and wheels mounted thereon and movable along the overall form assembly.

9. Production line equipment, as claimed in claim 8, comprising in addition, a tilt table assembly on which the overall form assembly is mounted, whereby the completed large concrete panel having the design thereon is tilted nearer to an upright position.

10. Production line equipment, as claimed in claim 9, wherein the tilt table assembly has rails on which the wheels mounted on the main frame is guided, whereby the stamp cart is controllably movable relative to the tilt table assembly and the overall form assembly mountable thereon.

11. Production line equipment, as claimed in claim 10, wherein the overall form assembly comprises, in addition, a bottom liner having an artistic design facing the concrete to be subsequently poured, during the first pour, whereby a completed large concrete panel has an artistic design on both sides.

12. Production line equipment, as claimed in claim 11, wherein the overall form assembly has a back rail form and a front rail form, which are spaced apart and parallel to each other, a top bulkhead form and a bottom bulkhead form, which are spaced apart and parallel to each other, and these forms when in contact with each other and the bottom liner, form a receiving volume to receive the first pour of concrete.

13. Production line equipment, as claimed in claim 12, wherein the back rail form and the front rail form have upstanding higher portions located near the rails on the tilt table assembly, which determine the height of a subsequent pour of concrete, which is poured before the first pour of concrete hardens to create pilasters located respectively adjacent to the back rail form and the front rail form.

14. Production line equipment, as claimed in claim 13, comprising, in addition, two inside back rail forms, which after the first pour of concrete, are each positioned respectively spaced inwardly and parallel to the back rail form and the front rail form to further determine the cross sectional area of pilasters to be created upon the second pour of concrete.

15. Production line equipment, as claimed in claim 14, comprising, in addition, four removable bulkhead forms, which, after the first pour of concrete are each positioned respectively at the respective ends of the back rail form, the front rail form, and the two inside back rail forms, to complete the volumes into which the second pour of concrete is poured to complete the pilasters made integrally with the large concrete panel.

16. Production line equipment, as claimed in claim 15, wherein the back rail form and the front rail form respectively have tongue and groove structures, for causing the formation of a tongue along one edge, and a groove along the other edge, of a large concrete panel in respect to the pilasters thereof, formed after two pours of concrete.

17. Production line equipment, as claimed in claim 16, wherein the tilt table assembly and other like tilt table assemblies are placed in alignment with one another, extending the tracks thereof to create an overall track run, along which the stamp cart is moved, and said tilt table assemblies have similar configurations.

18. Production line equipment, as claimed in claim 17, comprising, in addition, a cart for movement along the overall track run having a frame on which concrete reinforcing members such as wire mesh, rebar, anchor bolts and tie wires are placed for delivery along the production line.

19. Production line equipment, as claimed in claim 18, comprising, in addition, a vibrating screed cart for movement along the overall track run having a frame, and a vibrating screed assembly mounted on the frame.

20. Production line equipment, as claimed in claim 19, comprising, in addition, a powder cart for movement along the overall track run having a frame, had a vibrating, measuring, distributing, powder dispenser bin mounted on the frame, to selectively distribute powders of respectively selected color pigments onto the poured concrete.

21. Production line equipment, as claimed in claim 20, comprising in addition, a back rail cart for movement along the overall track run having a frame on which the inside back rail forms are placed for delivery to respective locations of an overall form assembly.

22. Production line equipment, as claimed in claim 21, wherein the cart for carrying the back rail forms has removable frame supports secured to the frame thereof to in turn support a selected number of inside back rail forms, and when the capacity thereof is reached, another frame support is substituted therefor on which additional inside back rail forms are supported.

23. Production line equipment, as claimed in claim 22, wherein the frame supports have transverse I-beams and the lower flanges serve as tracks, and the inside back, rail forms have roller assemblies, in turn having wheels for rolling on said tracks.

24. Production line equipment, as claimed in claim 23, wherein the cart for carrying the back rail forms has a hoist to lift and to lower the inside back rail forms.

25. Production line equipment, as claimed in claim 24, wherein the cart for carrying the back rail forms has selective track abutments, bump structures, and threaded in place abutments, to keep the inside back rail forms on the tracks of the frame supports.

26. Production line equipment, as claimed in claim 25, wherein the cart for carrying the back rail forms has pad eye structures on the frame supports to be interconnected with a forklift assembly, when the frame supports are removed from the frame of this back rail cart, and pad eye structures on the frame to be connected with a forklift assembly when the back rail cart is removed from the overall track run.

27. Production line equipment, as claimed in claim 26, comprising, in addition, a cart for movement along the overall track run having a frame, and a large roller assembly mounted on the frame, to receive a tarp, which is unrolled over all of the tilt table assemblies, when the overall form assemblies thereof have been filled with poured concrete to create the large concrete panels having integral pilasters, to create an overall cover left in place during the night to aid in reducing the curing time of the concrete, and this cart is used again in the morning, to roll up the tarp, and referred to as a tarp cart.

28. Production line equipment, as claimed in claim 27 comprising, in addition, a steam pipe for distributing steam through the length of the overall track run for heating the curing large concrete panels covered with the tarp.

29. Production line equipment, as claimed in claim 28, comprising, in addition, an electrical power distribution system extending the length of the overall track run, having continuous shielded contacts, referred to as an electric T-track power system, having a T-track.

30. Production line equipment, as claimed in claim 29, comprising, in addition an electrical circuit on each cart having electrical power pick up units to slidably interfit with the continuous shielded contacts, and also on each cart a common electrical drive system, having in turn electric propulsion motors, and reduction gears to drive respectively at least two wheels.

31. Production line equipment, as claimed in claim 30, comprising, in addition, on each cart, a transformer, and at least one lower voltage outlet to complete connections to respective power cords of respective hand held power tools.

32. Production line equipment, as claimed in claim 31, wherein the stamp cart has a hydraulic system, in turn comprising an electric motor, a hydraulic pump driven by the electric motor, a hydraulic conduit system, hydraulic actuators, which serve as the actuators used in moving respectively the vertical movement frame and the rocking frame, and hydraulic controls for operation by personnel in directing the movement of the rocking frame, when a design is made in the wet concrete.

33. Production line equipment, as claimed in claim 32, wherein the stamp cart has a liquid supply and liquid spraying system to spray a release and curing liquid on the wet concrete, as the stamp cart proceeds over the wet concrete, before the rocking frame is operated to create the design in the wet concrete.

34. Production line equipment, as claimed in claim 33, wherein the stamp cart has a hoisting assembly on the forward end thereof to be used when color templates are placed over the wet concrete prior to the follow on distribution of powders of color pigments to the wet concrete directed to surface areas not covered by the template, which is protecting the wet concrete below the color template from receiving the particular powder then being distributed on the wet concrete.

35. Production line equipment, as claimed in claim 34, comprising, in addition, color templates to be placed over wet concrete in selected places to protect these places from receiving powder of a particular color then being distributed on the wet concrete, thereby gaining a color contrast on the completed large concrete panel.

36. Production line equipment, as claimed in claim 35, comprising, in addition, a pivotal adjustable bull float assembly on the powder cart to distribute the powder of a color pigment.

37. Production line equipment, as claimed in claim 36, comprising, in addition, ratchet mechanisms on the stamp cart mounted adjacent to non electrical powered wheels of the stamp cart and operated to move these non electrical powered wheels during final adjustments in the positioning of the stamp cart relative to the overall form assembly.

38. Production line equipment, as claimed in claim 37, having temporary removable pour shields placed along the inside back rails before the second pour of concrete, to be ready to prevent any spilling of wet concrete of the second pour onto the wet concrete of the first pour, which has already been colored and stamped to create a design thereon.

39. Production line equipment, as claimed in claim 38, having a permanent steam shield located adjacent the electrical power distribution system in respect to the electric T-track power system thereof, to keep the steam away, when steam is used to shorten the curing time of the large concrete panels.

40. Production line equipment, as claimed in claim 39, having an extended track run, at least, at one end of the overall track run, on which the carts may be maneuvered, when these carts are not being used during a particular time of the production of the large concrete panels.

41. Production line equipment, as claimed in claim 12, wherein the tilt table assembly has receiving spaces for the placement of the front rail form, the top bulkhead form, and the bottom bulkhead form, when these respective forms are removed from about the substantially cured large concrete panel, such placement of these forms in these receiving spaces insuring they will remain with the tilt table assembly, when the tilting thereof occurs to position a large concrete panel in a near upright position.

42. Production line equipment, as claimed in claim 41, wherein the receiving space for the front rail form is provided by having tilt arms temporarily installed on the tilt table assembly along the front rail form side thereof.

43. Production line equipment, as claimed in claim 42, wherein tilt bracket assemblies are also temporarily installed on the tilt table assembly along the front rail form side thereof, and these tilt bracket assemblies directly contact the large concrete panel and serve to support this panel changing the center of rotation thereof from the center of rotation of the tilt table assembly, whereby the large concrete panel, when lifted by a forklift assembly, is moved clear of the liner on which the design has been created, to thereby avoid any possible damage thereto.

44. Production line equipment, as claimed in claim 43, wherein the back rail form has connecting members to be connected to a forklift assembly, when the forklift assembly is being operated to tilt the tilt table assembly, thereby keeping the back rail form in a ready position for the reuse thereof during the next production of a large concrete panel.

45. Production line equipment, as claimed in claim 44, wherein the tilt table assembly has a frame assembly, which along the back rail side thereof, has bearing plates arranged to rest on supporting plates secured by anchor bolts to respective concrete footings poured using large diameter column forms, and which, along the front rail side thereof, has hinge assemblies arranged for securement to supporting plates secured by anchor bolts to respective concrete footings poured using large diameter column forms.

46. Production line equipment, as claimed in claim 45, wherein the tilt table assembly has tilt table portions thereof to receive and to secure the overall form assembly, and to particularly receive a continuous steel plate on which the bottom liner is removably secured, which in turn comprises plywood and rubber like material secured to the plywood, with the rubber like material having an artistic design formed thereon.

47. Production line equipment, as claimed in claim 46, wherein the tilt table assembly has connecting members to be connected to a forklift assembly, when the forklift assembly is being operated to tilt the tilt table assembly, to present the large concrete panel closer to a vertical position thereof.

48. Production line equipment, as claimed in claim 47, wherein the tilt table assembly has receiving holes to receive transversely directed alignment and temporary securing pins which are passed through holes of the frame of the stamp cart to keep the stamp cart in position on the rails of the tilt table assembly, when the rocking frame is moved when a design is being created in the wet concrete.

49. Production line equipment, as claimed in claim 48, wherein at least two form lift assemblies are utilized, and particularly when one fork lift assembly is operable to tilt the tilt table assembly to position a large concrete panel resting thereon near an upright position thereof, and another forklift assembly is operated to lift the large concrete panel clear of the tilt table assembly, and move this panel to a place where other production steps may be undertaken.

50. Production line equipment, as claimed in claim 49, wherein hand held tools are available for use, comprising, bull floats, vibrators, rakes, shovels, brushes, scrapers, release oil dispensers, powder dispensers, powered tools for tightening and loosening fasteners, and for chipping away excess concrete.

51. Production line equipment, as claimed in claim 12, wherein a bottom bulkhead form is adjustably secured at selectable distances from a top bulkhead form to create large concrete panels of different specified lengths.

52. Production line equipment, as claimed in claim 15, wherein at least one of four removable bulkhead forms has spaced holes to accommodate protruding anchor bolts.

53. Production line equipment, as claimed in claim 52, wherein forms determining a cross sectional area of the integral pilaster where anchor bolts will protrude are larger, resulting in the integral pilaster, subsequently created, being larger in cross section than the other integral pilaster of the large concrete panel.

54. Production line equipment, as claimed in claim 45, wherein the frame assembly of the tilt table assembly extends longitudinally beyond a locale where the large concrete panel is made, to receive and to support a plank on which personnel may stand and walk when the large concrete panel is being made.

* * * * *